US012714198B2

(12) United States Patent
Farina

(10) Patent No.: US 12,714,198 B2
(45) Date of Patent: Aug. 25, 2026

(54) FOOTWEAR HEEL COUNTER

(71) Applicant: Walmart Apollo, LLC, Bentonville, AR (US)

(72) Inventor: Salvo Farina, Cave Springs, AR (US)

(73) Assignee: Walmart Apollo, LLC, Bentonville, AR (US)

( * ) Notice: Subject to any disclaimer, the term of this patent is extended or adjusted under 35 U.S.C. 154(b) by 38 days.

(21) Appl. No.: 18/047,628

(22) Filed: Oct. 18, 2022

(65) Prior Publication Data

US 2024/0122300 A1 Apr. 18, 2024

(51) Int. Cl.
*A43B 21/32* (2006.01)
*A43B 11/00* (2006.01)

(52) U.S. Cl.
CPC ..... *A43B 21/32* (2013.01); *A43B 11/00* (2013.01)

(58) Field of Classification Search
CPC ..... A43B 23/088; A43B 11/00; A43B 11/02; A43B 13/183; A43B 21/30; A43B 23/227; A43B 23/22; A43B 3/0063; A43B 23/08
USPC ..... 36/27, 38
See application file for complete search history.

(56) References Cited

U.S. PATENT DOCUMENTS 1,686,175 A * 10/1928 Read ..... A43B 3/101 36/58.5
D369,233 S 4/1996 Haber
7,243,444 B2 7/2007 Selner
D679,899 S 4/2013 Taestensen
D746,561 S 1/2016 Bikowski
9,241,533 B2 1/2016 Heard et al.
D765,963 S 9/2016 Lopatic
D808,132 S 1/2018 Sars
D816,972 S 5/2018 Pauk
D817,611 S 5/2018 Small
D822,349 S 7/2018 Petrenka
D832,568 S 11/2018 Kuerbis
10,136,698 B2 11/2018 Granger et al.
D841,298 S 2/2019 Small
D851,877 S 6/2019 Small
(Continued)

FOREIGN PATENT DOCUMENTS

EP 0096542 A1 12/1983
EP 1059044 12/2000
(Continued)

OTHER PUBLICATIONS

Translation of KR-20110014018-A (Year: 2011).*
(Continued)

*Primary Examiner* — Grady Alexander Nunnery
(74) *Attorney, Agent, or Firm* — Foley IP Law, PLLC

(57) ABSTRACT

An article of footwear includes an upper and a heel counter operatively connected to a heel region of the upper. The heel counter includes a cradle having a body. The body of the cradle includes a base and a cradle arm extending outward from the base to a tip portion of the cradle arm. The tip portion of the cradle arm is moveable relative to the base between an expanded position and a collapsed position. A spring is encased within the body of the cradle such that the spring biases the tip portion of the cradle arm toward the expanded position of the tip portion. The tip portion of the cradle arm is resiliently deflectable toward the collapsed position against the bias of the spring.

16 Claims, 11 Drawing Sheets

(56) References Cited

U.S. PATENT DOCUMENTS

| | | | | |
|---|---|---|---|---|
| D858,055 | S | 9/2019 | Kasprzak | |
| D880,136 | S | 4/2020 | Cristobal | |
| 10,638,810 | B1 * | 5/2020 | Cheney | A43B 3/248 |
| D895,245 | S | 9/2020 | Hardigan | |
| D897,655 | S | 10/2020 | Bove | |
| D899,754 | S | 10/2020 | Hatfield | |
| D905,421 | S | 12/2020 | Strother | |
| 10,973,279 | B2 | 4/2021 | Cheney | |
| D943,246 | S | 2/2022 | Du | |
| D943,886 | S | 2/2022 | Hardigan | |
| D943,899 | S | 2/2022 | Hoang | |
| D943,904 | S | 2/2022 | Giard | |
| D943,946 | S | 2/2022 | Cheney | |
| D968,765 | S | 11/2022 | Zhang | |
| D970,188 | S | 11/2022 | Han | |
| D980,589 | S | 3/2023 | Whittington | |
| D987,261 | S | 5/2023 | Cristobal | |
| D987,269 | S | 5/2023 | Cristobal | |
| D994,310 | S | 8/2023 | Jalbert | |
| D994,311 | S | 8/2023 | Jalbert | |
| D995,047 | S | 8/2023 | Jalbert | |
| D997,538 | S | 9/2023 | Schenone | |
| D1,000,770 | S | 10/2023 | Petrenka | |
| D1,000,797 | S | 10/2023 | Jalbert | |
| D1,000,809 | S | 10/2023 | Kanata | |
| D1,004,258 | S | 11/2023 | Schloegel | |
| D1,014,016 | S | 2/2024 | Witherow | |
| 11,918,071 | B2 | 3/2024 | Cheney | |
| D1,024,497 | S | 4/2024 | Giard | |
| 11,963,581 | B2 | 4/2024 | Kilgore | |
| D1,032,152 | S | 6/2024 | Du | |
| D1,033,044 | S | 7/2024 | Cheney | |
| D1,065,784 | S | 3/2025 | Guarnier | |
| D1,071,523 | S | 4/2025 | Farina | |
| 2007/0101617 | A1 | 5/2007 | Brewer et al. | |
| 2011/0010964 | A1 | 1/2011 | Hardy et al. | |
| 2011/0185592 | A1 * | 8/2011 | Nishiwaki | A43B 23/17 36/69 |
| 2014/0230280 | A1 | 8/2014 | Heard et al. | |
| 2017/0303632 | A1 * | 10/2017 | Pratt | A43B 3/248 |
| 2018/0110292 | A1 * | 4/2018 | Beers | A43B 11/00 |
| 2018/0116340 | A1 * | 5/2018 | Chang | A43C 7/00 |
| 2020/0022451 | A1 * | 1/2020 | Smith | B29C 39/003 |
| 2020/0205516 | A1 | 7/2020 | Kilgore | |
| 2020/0229536 | A1 * | 7/2020 | Hopkins | A43B 11/02 |
| 2020/0305552 | A1 | 10/2020 | Cheney et al. | |
| 2021/0059351 | A1 | 3/2021 | Piacentini | |
| 2021/0321718 | A1 | 10/2021 | Chang | |
| 2023/0033366 | A1 | 2/2023 | Farina | |
| 2023/0346069 | A1 * | 11/2023 | Becker | A43B 21/32 |
| 2024/0115007 | A1 | 4/2024 | Kilgore | |
| 2024/0122300 | A1 | 4/2024 | Farina | |

FOREIGN PATENT DOCUMENTS

| | | | | |
|---|---|---|---|---|
| KR | 20110014018 A * | 2/2011 | | A43B 11/00 |
| WO | 2023/059708 A1 | 4/2023 | | |

OTHER PUBLICATIONS

Unknown, Z-Coil Footwear, Fitting & Adjusting Z-CoiLFootwear, Working with the Coi, date unknown, www.zcoil.com, 28 pages.

Rodriguez, K. "International Search Report & Written Opinion", International Application No. PCT/US2023/018503, mailed Aug. 23, 2023, 10 pages.

Han, Jonathan J., Restriction Requirement Office Action issued Aug. 2, 2024 in connection with Design U.S. Appl. No. 29/867,293, 9 pages.

* cited by examiner

FOOTWEAR HEEL COUNTER

BACKGROUND

Putting an article of footwear on an individual's foot often requires the individual to use one or both hands and/or one or more tools (e.g., a shoehorn, etc.), for example to stretch and/or collapse the ankle opening and hold the heel region of the footwear to enable the individual's foot to slide into the foot-receiving cavity of the footwear through the ankle opening.

SUMMARY

The following presents a simplified summary of the disclosure in order to provide a basic understanding to the reader. This summary is not intended to identify key features or essential features of the claimed subject matter nor is it intended to be used to limit the scope of the claimed subject matter. Its sole purpose is to present a selection of concepts disclosed herein in a simplified form as a prelude to the more detailed description that is presented later.

According to a first aspect there is an article of footwear that includes an upper and a heel counter operatively connected to a heel region of the upper. The heel counter includes a cradle having a body. The body of the cradle includes a base and a cradle arm extending outward from the base to a tip portion of the cradle arm. The tip portion of the cradle arm is moveable relative to the base between an expanded position and a collapsed position. A spring is encased within the body of the cradle such that the spring biases the tip portion of the cradle arm toward the expanded position of the tip portion. The tip portion of the cradle arm is resiliently deflectable toward the collapsed position against the bias of the spring.

According to a second aspect there is an article of footwear that includes an upper and a heel counter operatively connected to a heel region of the upper. The heel counter includes a cradle that includes a base that extends a length along a longitudinal axis from a rear end portion of the base to a front-end portion of the base. The rear end portion of the base includes a hub. The base includes lateral and medial legs that extend lengths outward from the hub along the longitudinal axis. The length of the lateral leg is greater than the length of the medial leg.

According to a third aspect there is a method for assembling an article of footwear that includes an upper and a heel counter that includes a cradle. The method includes encasing a spring within a body of the cradle such that the spring biases a tip portion of a cradle arm of the cradle toward an expanded position of the tip portion. The method includes mounting the cradle to a heel region of the upper of the article of footwear such that the tip portion of the cradle arm is resiliently deflectable from the expanded position toward a collapsed position of the tip portion against the bias of the spring.

Many of the attendant features will be more readily appreciated as the same becomes better understood by reference to the following detailed description considered in connection with the accompanying drawings.

DESCRIPTION OF THE DRAWINGS

The present description will be better understood from the following detailed description read in light of the accompanying drawings, wherein.

Like reference numerals are used to designate like parts in the accompanying drawings.

DETAILED DESCRIPTION

Figure 1:
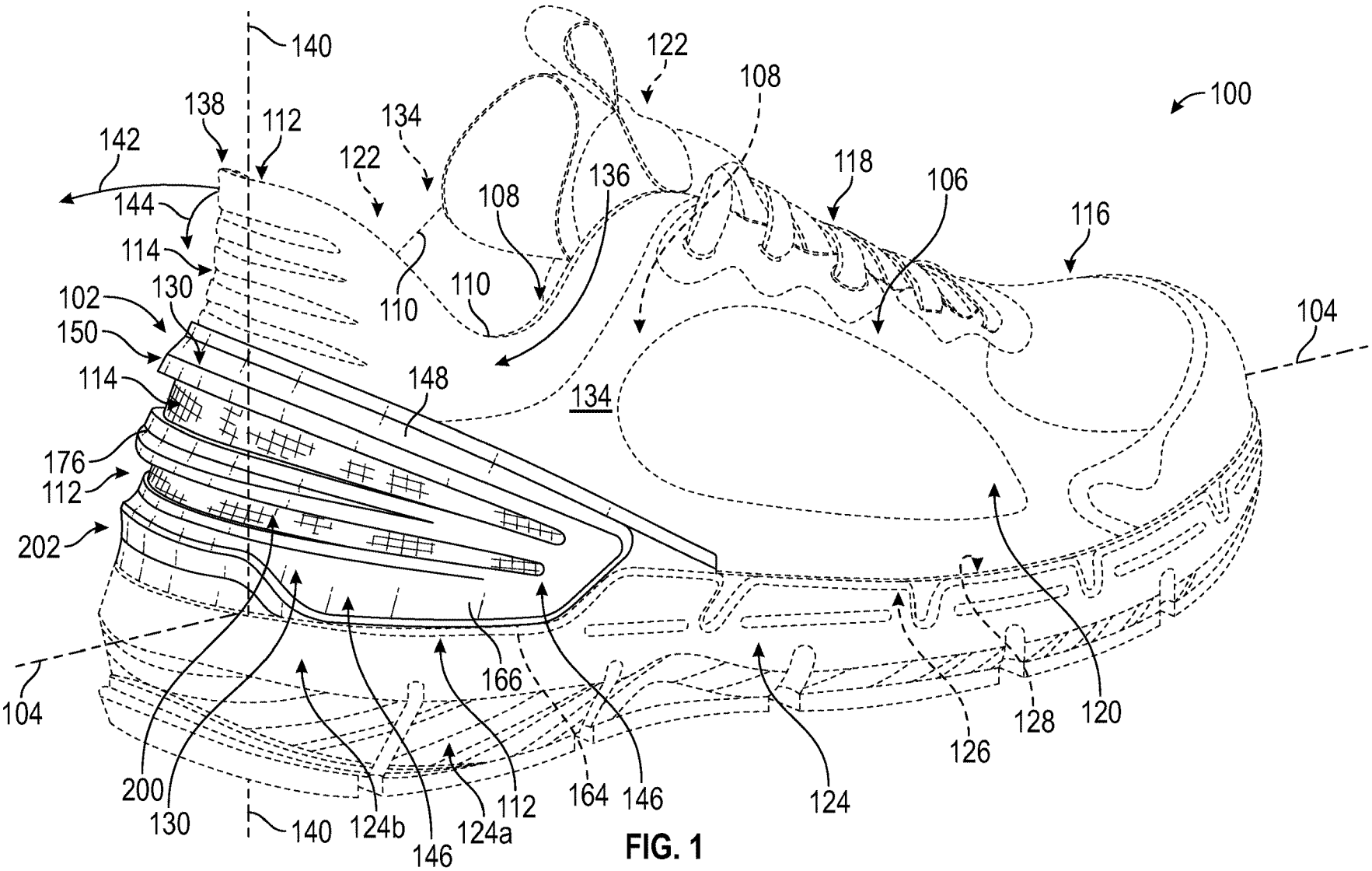
FIG. 1 is a perspective view illustrating an exemplary article of footwear according to an implementation.

The detailed description provided below in connection with the appended drawings is intended as a description of the present examples and is not intended to represent the only forms in which the present examples are constructed or utilized. The description sets forth the functions of the examples and the sequence of operations for constructing and operating the examples. However, the same or equivalent functions and sequences may be accomplished by different examples.

While various spatial and directional terms, such as "top," "bottom," "front," "rear," "upper," "lower," "vertical," "upward," and/or the like are used to describe implementations of the present application, it is understood that such terms are merely used with respect to the orientations shown in the drawings. The orientations can be inverted, rotated, or otherwise changed such that the spatial and directional terms apply differently, for example if the structure is flipped 180°: a top side becomes a bottom side; upward becomes downward; a left side becomes a right side; vice versa; and/or the like. Moreover, and for example, vertical may become horizontal when the structure is rotated 90°.

Slipping an individual's foot into the upper of an article of footwear can be difficult without using one or both hands and/or one or more tools (e.g., a shoehorn, etc.). For example, a hand and/or tool may be required to stretch the ankle opening of the footwear and hold the heel region of the upper in the stretched position to enable the foot to be successfully inserted into the foot-receiving cavity of the upper. The examples described below are not limited to implementations which solve any or all of the disadvantages of known footwear.

Certain implementations provide an article of footwear that include an upper and a heel counter operatively connected to a heel region of the upper. The heel counter includes a cradle having a body. The body of the cradle includes a base and a cradle arm extending outward from the base to a tip portion of the cradle arm. The tip portion of the cradle arm is moveable relative to the base between an expanded position (shown in FIG. 10) and a collapsed position (shown in FIG. 9). A spring is encased within the body of the cradle such that the spring biases the tip portion of the cradle arm toward the expanded position of the tip portion. The tip portion of the cradle arm is resiliently deflectable toward the collapsed position against the bias of the spring. Certain implementations provide a method for assembling an article of footwear that includes encasing a spring within a body of a cradle of a heel counter such that the spring biases a tip portion of a cradle arm of the cradle toward an expanded position of the tip portion.

Certain implementations alleviate the difficulty of slipping an individual's foot into an article of footwear by providing a resiliently collapsible heel counter that enables an individual's foot to be received into the foot-receiving cavity of the upper of an article of footwear without the use of a hand and/or other tools (e.g., only the individual's foot is required for successful insertion into the foot-receiving cavity, etc.). Certain implementations thus enhance the ease of foot entry, allowing hands-free foot entry into an article of footwear. Certain implementations ease manufacturing of articles of footwear, for example by reducing the cost, complexity, and/or difficulty of manufacturing an article of footwear and/or a component thereof (e.g., a heel counter, a cradle, a spring, etc.).

Pronation is the natural movement of the foot that occurs during foot landing while running or walking. Overpronation occurs when a person pushes off mostly from the big toe and second toe instead of distributing weight more evenly among all of the toes. As a result, the shock from the foot's impact doesn't spread evenly throughout the foot and the ankle has trouble stabilizing the rest of the body. Overpronation may also cause an unnatural angle to form between the foot and ankle such that the foot splays out abnormally. Overpronation may result in injury, fatigue, and/or the like. For example, overpronation may have secondary effects on the lower legs, such as increased rotation of the tibia, which may cause lower leg and/or knee problems. Moreover, and for example, overpronation may cause overuse injuries (e.g., medial tibial stress syndrome sometimes referred to as "shin splints", knee pain, etc.).

Certain implementations provide an article of footwear that includes an upper and a heel counter operatively connected to a heel region of the upper. The heel counter includes a cradle that includes a base that extends a length along a longitudinal axis from a rear end portion of the base to a front-end portion of the base. The rear end portion of the base includes a hub. The base includes lateral and medial legs that extend lengths outward from the hub along the longitudinal axis. In some examples, the lateral leg extends along a lateral longitudinal arch of the article of footwear, a cuboid bone of a foot of a wearer, and/or a lateral longitudinal arch of a foot of a wearer of the article of footwear. In some examples, the length of the lateral leg is greater than the length of the medial leg.

Certain implementations may reduce or eliminate overpronation of the foot of a wearer of an article of footwear. For example, certain implementations may reduce ankle joint eversion movement, plantar force, and/or at least one component of triplanar motion of the foot. Accordingly, certain implementations of the heel counters and methods disclosed herein may reduce injury, fatigue, and/or the like caused by overpronation of a wearer's foot. It should be appreciated that individual results may vary.

Figure 9:
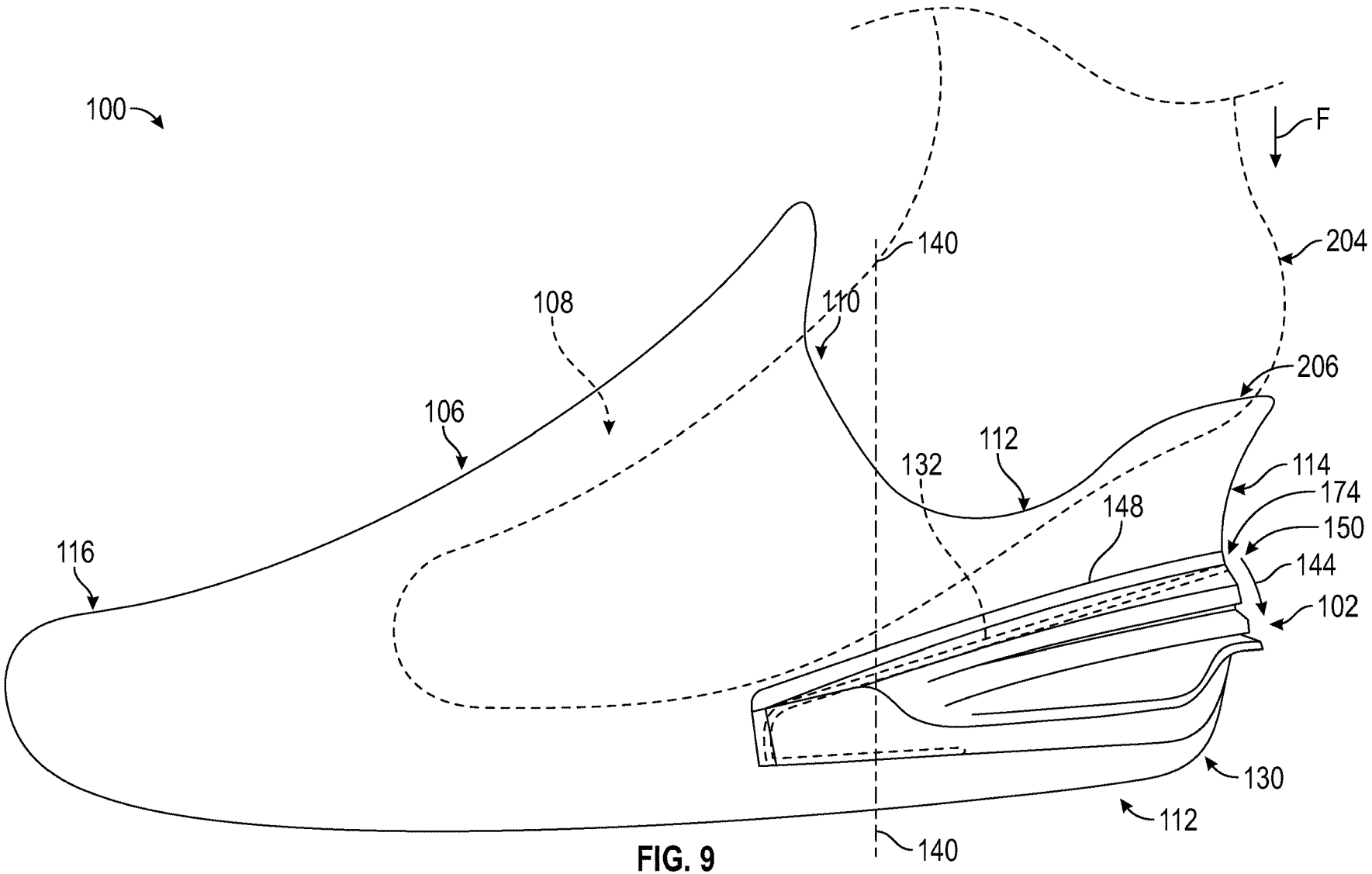
FIGS. 9-11 are schematic diagrams illustrating operation of the heel counter shown in FIG. 2 within the footwear shown in FIG. 1 according to an implementation.

With references now to the figures, FIG. 1 illustrates an exemplary article of footwear 100 that includes a heel counter 102 that is configured to facilitate (e.g., ease, assist, etc.) entry of an individual's foot into the footwear 100. The footwear 100 extends a length along a longitudinal axis 104. The footwear 100 includes an upper 106 that extends a length along the longitudinal axis 104. The upper 106 defines a foot-receiving cavity 108 having an ankle opening 110. The foot-receiving cavity 108 is configured to receive an individual's foot (e.g., as shown in FIG. 9, etc.) therein through the ankle opening 110. The footwear 100 illustrated herein is depicted as an athletic shoe, but the footwear 100 is not limited to athletic shoes generally nor the specific type, design, category, and/or the like of athletic shoe illustrated herein. Rather, the footwear 100 may include any article of footwear (e.g., any type, design, category, functionality, etc.), such as, but not limited to, leisure shoes, dress shoes, work shoes, sandals, slippers, boots, booties, and/or the like.

Figure 10:
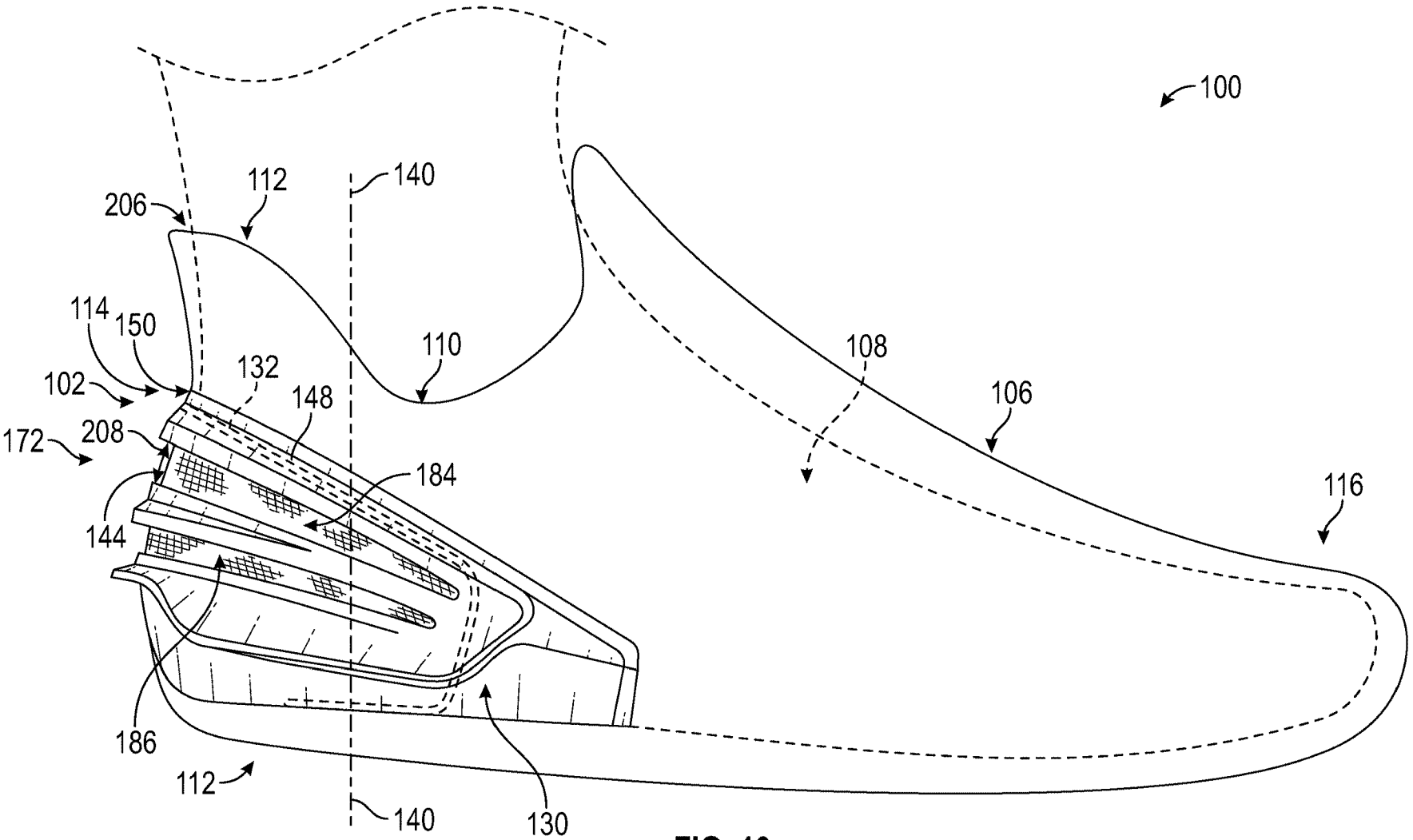

As shown in FIG. 1 and will be described below, the heel counter 102 is configured to be installed to a heel region 112 of the upper 106 of the footwear 100. The heel region 112 generally includes portions of the footwear 100 corresponding with the posterior (i.e., rear or back) portions of a human foot (e.g., including the heel, including the calcaneus bone, including at least a portion of the Achilles tendon, etc.) when the footwear 100 is worn by a human individual. For example, the heel region 112 of the upper 106 includes a posterior wall 114 that is configured to extend behind and support the posterior of an individual's heel when the individual's foot is received within the foot-receiving cavity 108 of the upper 106 (e.g., as shown in FIG. 10, etc.).

The upper 106 of the footwear 100 includes a forefoot region 116 that generally includes portions of the footwear 100 corresponding with the anterior (i.e., front) portions of a human foot (e.g., including the toes, the joints connecting the metatarsals with the phalanges, etc.) when the footwear 100 is worn by a human individual. For example, the forefoot region 116 of the upper 106 extends over at least a portion of the anterior of an individual's foot when the individual's foot is received within the foot-receiving cavity 108, for example as shown in FIG. 10, etc. A midfoot region 118 of the footwear 100 is disposed between the heel region 112 and the forefoot region 116 and generally includes portions of the footwear 100 corresponding with a longitudinal arch area of the human foot (e.g., including the navicular joint, the cuboid bone, etc.) when the individual's foot is received within the foot-receiving cavity 108 of the upper 106 (e.g., as shown in FIG. 10, etc.). The upper 106 of the footwear 100 includes a lateral side 120 and an opposite medial side 122.

The footwear 100 includes a sole structure 124 to which the upper 106 is secured. The sole structure 124 includes one or more sole components that define any number of layers of the sole structure 124. For example, the sole structure 124 may include an outsole and a midsole that are discrete components joined together. In another example illustrated in the exemplary implementation shown in FIG. 1, the sole structure 124 has a unitary combination of an outsole **124*a* and a midsole 124*b*, commonly referred to as a unisole. The sole structure 124 underlies the upper 106. For example, a bottom wall 126 (e.g., a lasting board, etc.) of the upper 106 is secured to an upper side 128 (e.g., of the midsole 124*b*) of the sole structure 124**, for example using any suitable method, means, structure, material, fastener, and/or the like, such as, but not limited to, adhesive, cement, thermal bonding, welding, stitching, sewing, riveting, and/or the like.

Traditionally, slipping an individual's foot into the upper of an article of footwear often requires the use of one or both hands and/or one or more tools (e.g., a shoehorn, etc.) to stretch the ankle opening and hold the heel region of the upper in the stretched position as the foot is inserted into the foot-receiving cavity of the upper. The heel counter 102 of the present application alleviates this difficulty by enabling an individual's foot to be received into the foot-receiving cavity of the upper of an article of footwear without requiring the use of a hand and/or other tools (e.g., only the individual's foot is required for successful insertion into the foot-receiving cavity, etc.). In other words, the various implementations of heel counters and methods disclosed herein enhance the ease of foot entry, allowing hands-free foot entry into an article of footwear. As will be described in more detail below, the heel counter 102 includes a cradle 130 and a spring 132 (not visible in FIG. 1) that is encased within the material of a body 400 of the cradle 130.

Optionally, the upper 106 includes a stretchable material (e.g., an elastic material, a stretchable fabric, a 4-way stretch nylon fabric, etc.) along and/or adjacent the heel region 112 of the upper 106 to increase the amount of stretching of the ankle opening 110 along the longitudinal axis 104, for example to facilitate (e.g., assist, etc.) the functionality of the heel counter 102 (e.g., enabling at least partial collapse of the heel region 112 of the upper 106, enabling stretching of the ankle opening 110 along the longitudinal axis 104, enabling entry of an individual's foot into the footwear 100 without the use of a hand and/or other tools, etc.). For example, in the exemplary implementation of FIG. 1, sidewalls 134 of the upper 106 include optional elastic stretch points 136 that increase the amount of stretching of the ankle opening 110 along the longitudinal axis 104. In other words, the stretch points 136 are configured to enable an end 138 of the posterior wall 114 of the heel region 112 of the upper 106 to move along the longitudinal axis 104 and/or otherwise (e.g., along a vertical axis 140, etc.) of the footwear 100 (e.g., in the direction of the arrow 142, in the direction of the arrow 144, etc.). In another example, one or more segments (e.g., the sidewalls 134 within and/or adjacent to the heel region 112, the posterior wall 114 of the heel region 112, etc.) of the upper 106 optionally includes a stretchable material to enable the ankle opening 110 to stretch further along the longitudinal axis 104 and/or otherwise of the footwear 100. In some implementations, the upper 106 does not include a stretchable material.

Figure 2:
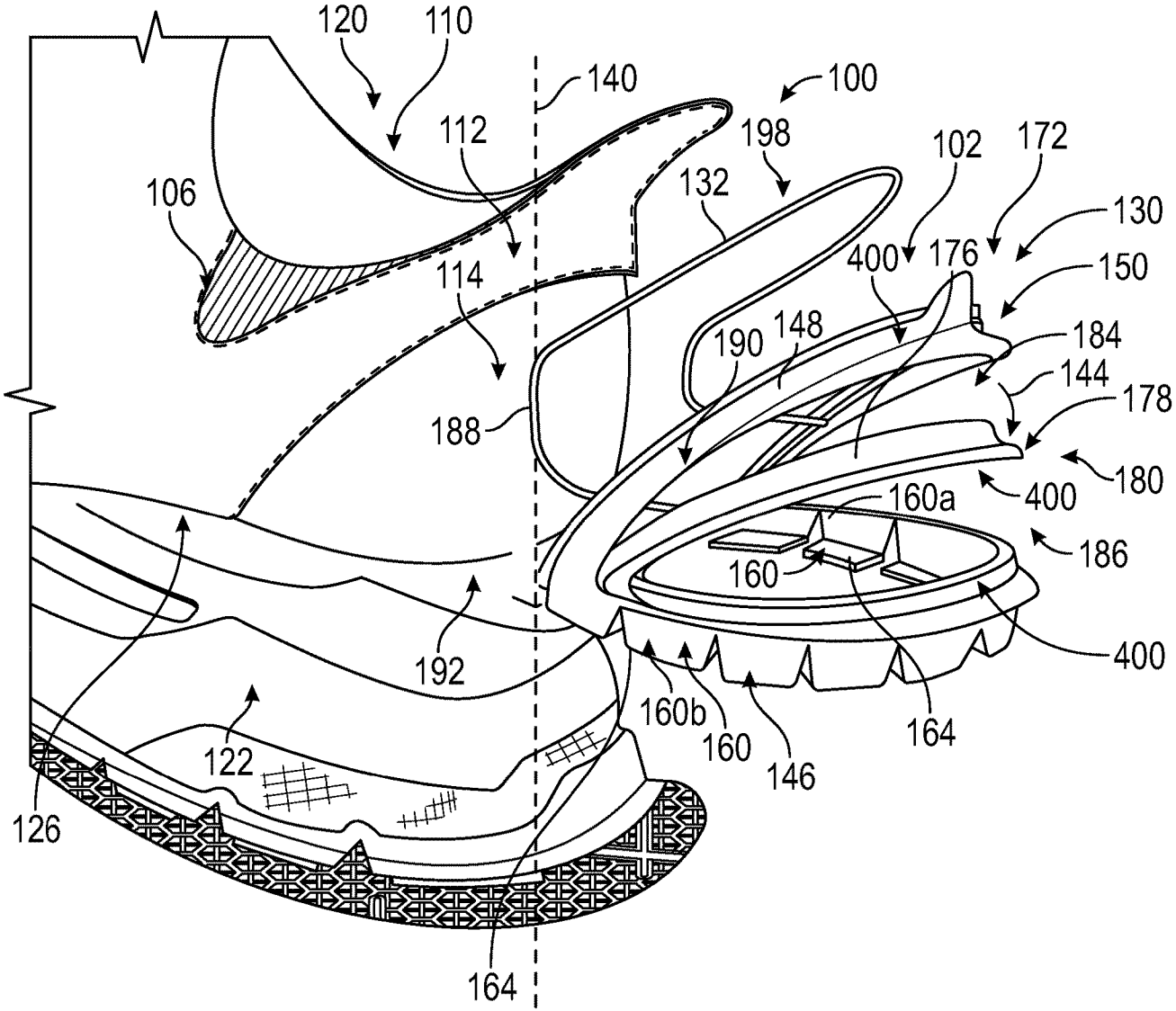
FIG. 2 is an exploded perspective view of the article of footwear shown in FIG. 1 illustrating a heel counter according to an implementation.

Referring now to FIGS. 1 and 2, the body 400 of the cradle 130 of the heel counter 102 includes a base 146 and a cradle arm 148 that extends outward from the base 146 to a tip portion 150 of the cradle arm 148. As will be described below, the spring 132 of the heel counter 102 is operatively connected to the cradle arm 148 for providing a spring force that biases the cradle arm 148 against movement in the direction 144.

Figure 3:
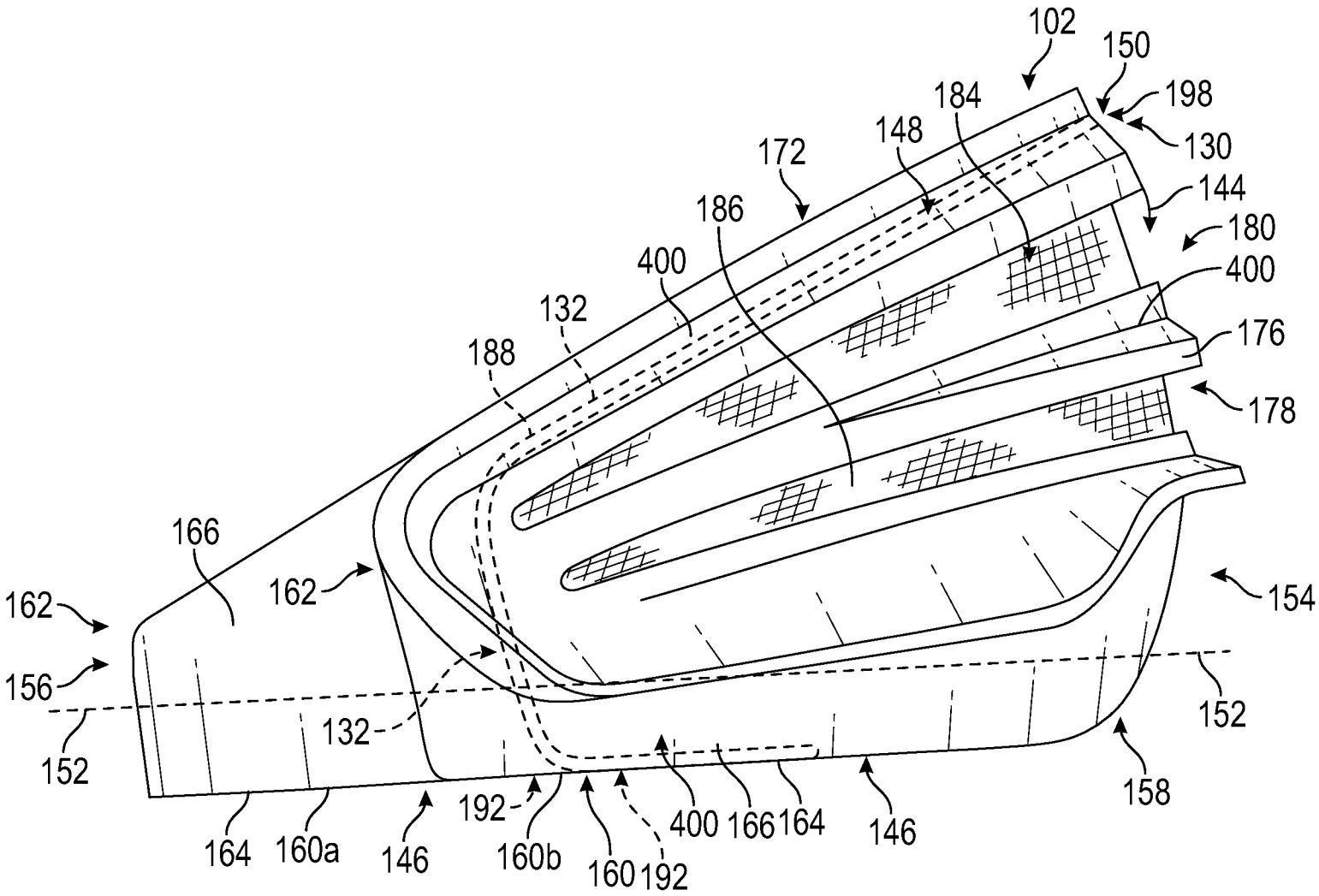
FIG. 3 is a medial side elevational view of the heel counter shown in FIG. 2 according to an implementation.
Figure 4:
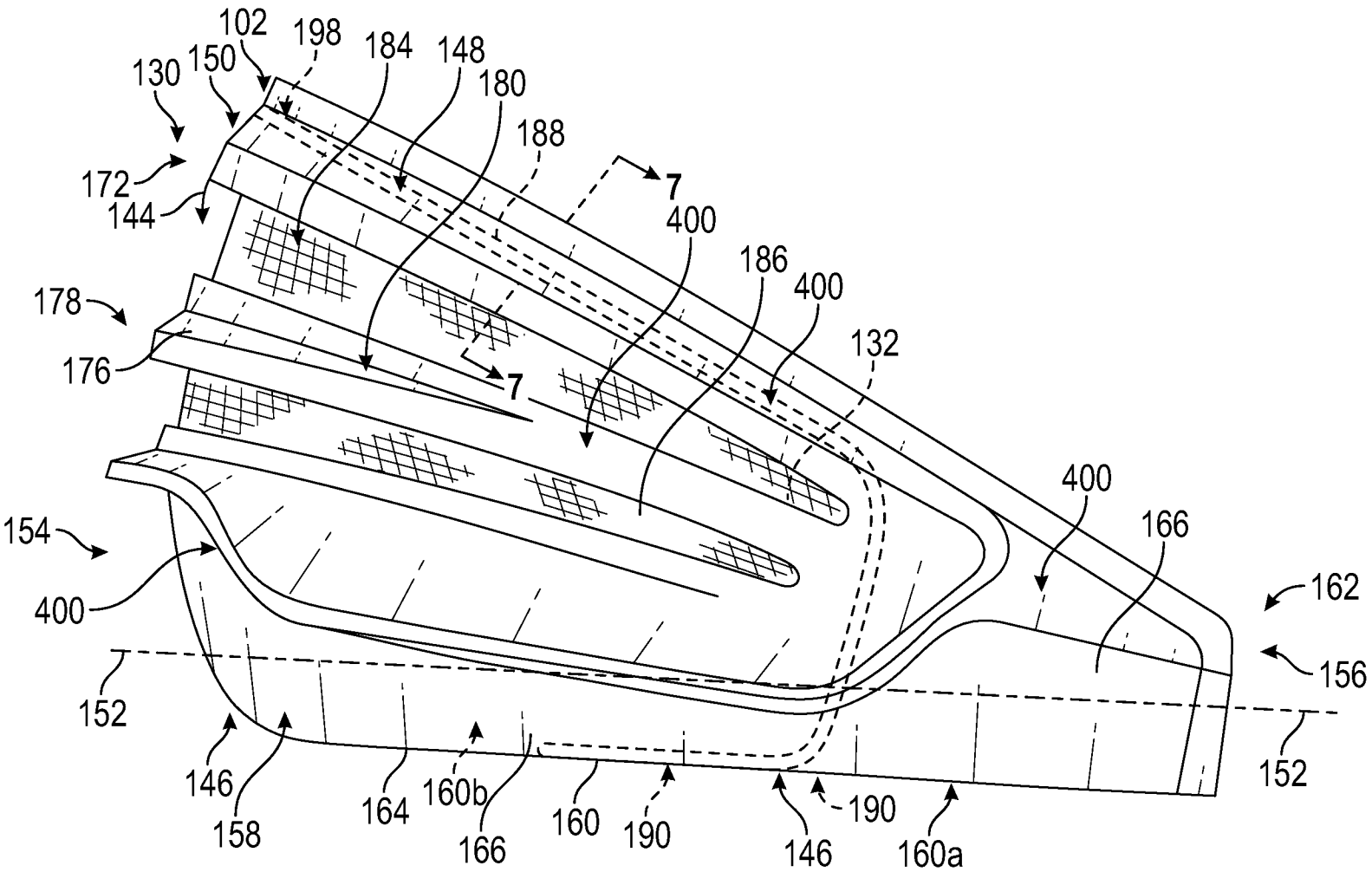
FIG. 4 is a lateral side elevational view of the heel counter shown in FIG. 2 according to an implementation.
Figure 5:
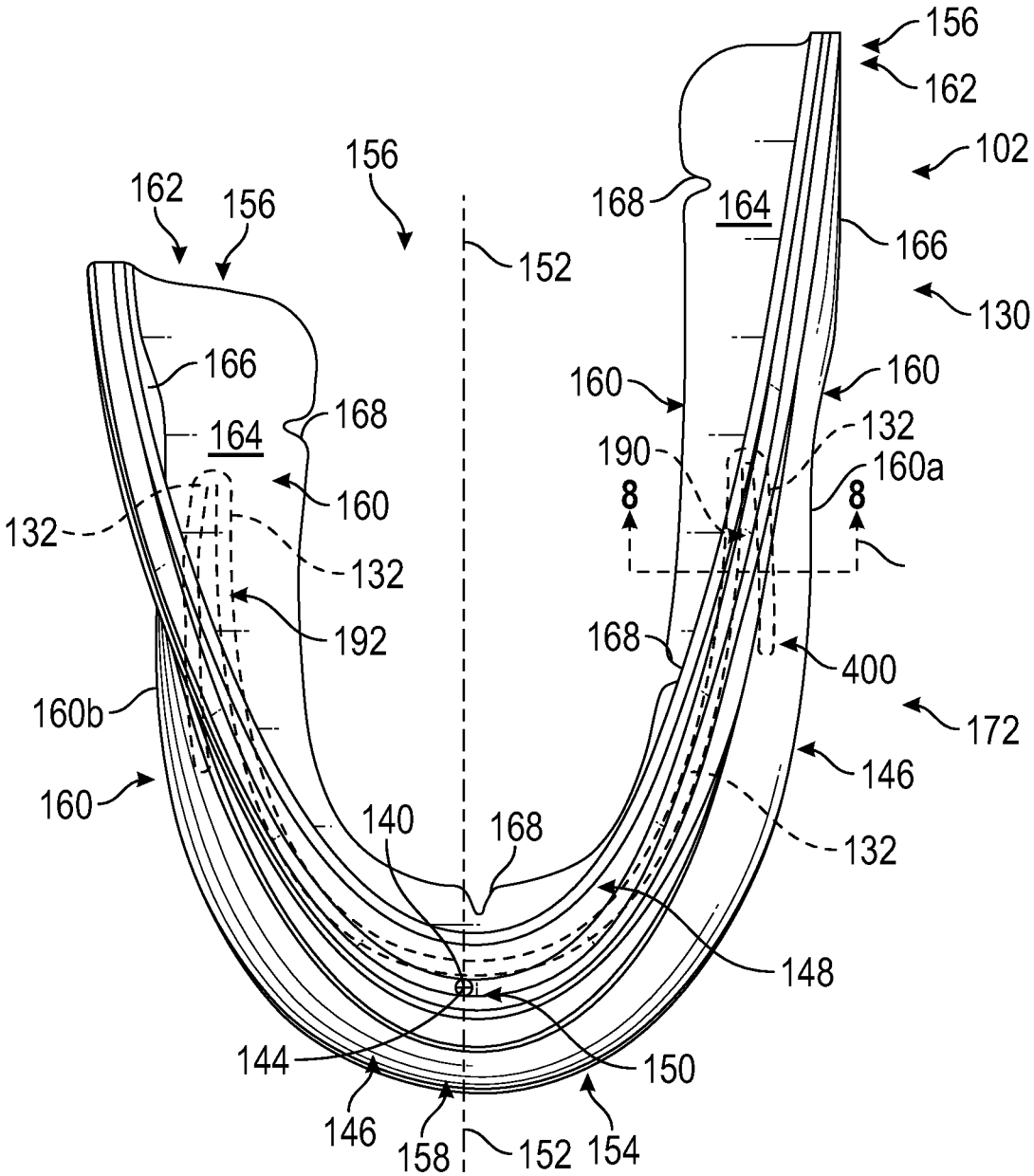
FIG. 5 is a top plan view of the heel counter shown in FIG. 2 according to an implementation.

Referring now to FIGS. 3-5, the base 146 of the cradle 130 extends a length along a longitudinal axis 152 from a rear end portion 154 to a front-end portion 156. The rear end portion 154 of the base 146 includes a hub 158 of the base 146. The base 146 includes legs 160 that extend outward from the hub 158 along the longitudinal axis 152 to end portions 162 of the legs 160. For example, the base 146 includes a lateral leg **160*a* that extends along the lateral side 120 (not shown in FIGS. 3-5) of the upper 106 and a medial leg 160*b* that extends along the medial side 122 (not shown in FIGS. 3-5) of the upper 106. In the exemplary implementation shown herein, the legs 160 include bottom walls 164 and side walls 166. As shown in FIG. 1, when the heel counter 102 is installed within the heel region 112 of the upper 106: the bottom walls 164 of the legs 160 extend along the bottom wall 126 of the upper 106 and the upper side 128 of the sole structure 124; and the side walls 166 of the legs 160 extend along the sidewalls 134 and the posterior wall 114 of the upper 106. In other examples, one or more of the legs 160 does not include the side wall 166 and/or the bottom wall 164. In the exemplary implementation, the longitudinal axis 152 of the base 146 extends approximately parallel to the longitudinal axis 104 of the footwear 100 when the cradle 130 is operatively connected to the heel region 112 of the upper 106**.

Referring now to FIG. 5, optionally, the end portions 162 of the legs 160 are free end portions such that the front-end portion 156 of the base 146 is open. For example, in the exemplary implementation shown herein, the base 146 includes an open front-end portion 156 and a closed rear end portion 154 that defines a U-shape (i.e., the base 146 includes a U-shape in the exemplary implementation). In addition or alternatively to the U-shape shown herein, the base 146 may include any other shape that enables the cradle 130 to function as described and/or illustrated herein, such as, but not limited to a shape that is closed at the front end portion 156, a V-shape, a horseshoe shape, a circular shape, an oval shape, a rectangular shape, a shape having three or more sides, and/or the like.

In some implementations, the open-ended shape of the front-end portion 156 enables the heel counter 102 to be accommodated by (i.e., operatively connected to, used with, implemented within, etc.) a greater variety of different sizes and shapes of footwear. For example, the open-ended shape of the front-end portion 156 of the base 146 enables the size and/or shape of the base 156 to be adjusted by moving the free end portions 162 of the legs 160 toward or away from each other. Accordingly, the open-ended shape of the front-end portion 156 of the base 146 may reduce the number of different versions (e.g., sizes, shapes, etc.) of the heel counter 102 required to serve a given number of different sizes and shapes of footwear, which may reduce manufacturing costs. Optionally, one or more of the bottom walls 164 and/or one or more of the side walls 166 of the legs 160 of the base 146 include one or more slots and/or other openings that enable further adjustment of the size and/or shape of the base 146. For example, the exemplary implementation of the base 146 shown in FIG. 5 includes slots 168 that extend into the bottom walls 164 of the legs 160.

Figure 6:
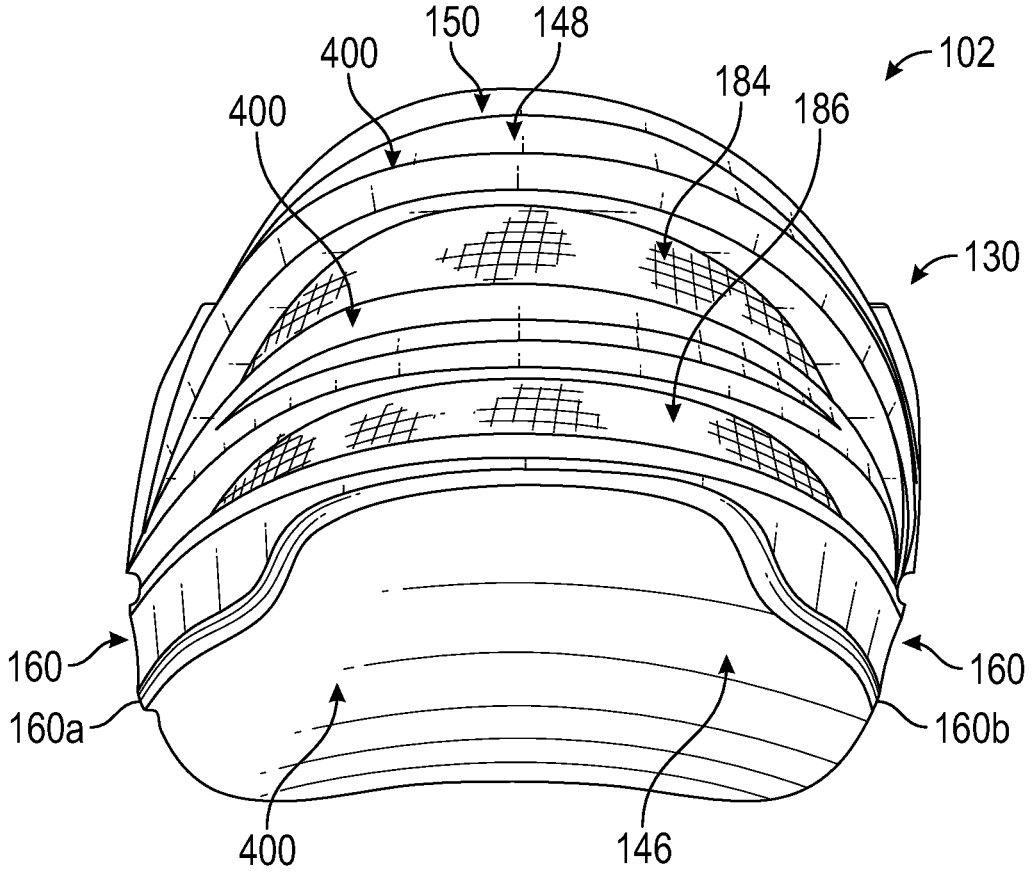
FIG. 6 is a rear elevational view of the heel counter shown in FIG. 2 according to an implementation.

Referring now to FIGS. 3-6, the cradle arm 148 of the cradle 130 of the heel counter 102 extends outward from the base 146 to the tip portion 150 of the cradle arm 148. As will be described below, when the heel counter 102 is operatively connected to the heel region 112 of the upper 106, the cradle arm 148 extends upward toward the ankle opening 110 and toward the posterior wall 114 of the heel region 112. In the exemplary implementation, and as seen in FIGS. 5 and 6, the cradle arm 148 extends a length along a continuous path between the legs 160 of the base 146. In other words, the length of the cradle arm 148 extends continuously from the lateral leg **160*a* of the base 146 to the medial leg 160*b* of the base 146, with the tip portion 150 extending at approximately a point of curvature location along the length of the cradle arm 148. In other implementations, the length of the cradle arm 148 is not continuous between the legs 160*a* and 160*b* of the base 146, but rather is segmented into any number of segments that enables the cradle arm 148 to function as described and/or illustrated herein (e.g., two segments that extend outward from a corresponding leg 160** of the base 146 to free end portions that are spaced apart by a gap and that define the tip portion 150, etc.).

Referring again to FIGS. 3-5, the tip portion 150 of the cradle arm 148 is moveable relative to the base 146 between an expanded position 172 (shown in FIG. 10) and a collapsed position 174 (shown in FIG. 9). The expanded position 172 of the tip portion 150 is the natural resting position of the cradle arm 148 shown in FIGS. 3-5. In the collapsed position, the tip portion 150 has been moved (e.g., deflected, etc.) relative to the base 146 from the natural resting position in the direction 144. As will be described below, when the heel counter 102 is operatively connected to the heel region 112 of the upper 106, the cradle arm 148 is positioned along the heel region 112 such that the tip portion 150 moves between the expanded position 172 and the collapsed position 174 along the vertical axis 140 of the footwear 100. As will also be described below, movement of the tip portion 150 from the expanded position 172 to the collapsed position 174 collapses the heel region 112 of the upper 106 along the vertical axis 140, for example to enhance the ease of foot entry and thereby allows hands-free foot entry into the article of footwear 100.

In the exemplary implementation shown herein, and as seen in FIGS. 2-4, the tip portion 150 of the cradle arm 148 moves along an arc between the expanded position 172 and the collapsed position 174 of the tip portion 150. For example, the direction 144 extends along an arc as shown herein. As will be described below, when the heel counter 102 is operatively connected to the heel region 112 of the upper 106, movement of the tip portion 150 of the cradle arm 148 from the expanded position 172 toward the collapsed position 174 along an arc causes the tip portion 150 to move along the longitudinal axis 104 of the footwear 100, for example which may stretch the ankle opening 110 of the upper 106 along the longitudinal axis 104 of the footwear 100. In other implementations, the tip portion 150 of the cradle arm 148 moves along a linear (i.e., straight) path between the expanded position 172 and the collapsed position 174 of the tip portion 150.

Optionally, the body 400 of the cradle 130 includes another cradle arm 176. The cradle arm 176 extends outward from the base 146 to a tip portion 178 of the cradle arm 176. The cradle arm 176 extends between cradle arm 148 and the base 146 along the height (e.g., along the vertical axis 140, etc.) of the heel region 112 of the upper 106. As will be described below, when the heel counter 102 is operatively connected to the heel region 112 of the upper 106, the cradle arm 176 extends upward toward the ankle opening 110 and toward the posterior wall 114 of the heel region 112. The tip portion 178 of the cradle arm 176 is moveable relative to the base 146 between an expanded position 180 and a collapsed position 182 thereof in a similar manner to the tip portion 150 of the cradle arm 148. An example of the collapsed position 182 of the tip portion 178 of the cradle arm 176 is shown in FIG. 9.

One or more collapsible windows are defined between the cradle arm 148 and the base 146. For example, a collapsible window 184 is defined between the cradle arm 148 and the cradle arm 176; and a collapsible window 186 is defined between the cradle arm 176 and the base 146. As will be described below, the collapsible windows 184 and 186 are configured to collapse along the vertical axis 140 of the footwear 100 as the cradle arms 148 and 176 move toward the collapsed positions 174 and 182, respectively, thereof. The heel counter 102 may include any number of collapsible windows 184 and/or 186 (e.g.; a single collapsible window, for example in implementations that do not include the cradle arm 176; three collapsible windows, for example in implementations that include a third cradle arm; etc.).

In the exemplary implementation, the cradle arm 176 extends a length along a continuous path between the legs 160 of the base 146 (i.e., extends continuously from the lateral leg 160*a* to the medial leg 160*b*). In other implementations, the length of the cradle arm 148 is not continuous between the legs 160 of the base 146, but rather is segmented into any number of segments that enables the heel counter 102 to function as described and/or illustrated herein (e.g., two segments that extend outward from a corresponding leg 160 of the base 146 to free end portions that are spaced apart by a gap and that define the tip portion 178, etc.). Although two are shown in the exemplary implementation, the cradle 130 may include any number of cradle arms. The cradle arm 148 may be referred to herein as a "first" cradle arm, while the cradle arm 176 may be referred to herein as a "second" cradle arm.

Referring again to FIG. 2, the body 400 of the cradle 130 may be fabricated from any material(s) that enable the heel counter 102 to function as described and/or illustrated herein. Examples of suitable materials used to fabricate the body 400 of the cradle 130 include, but are not limited to, silicone, plastics, thermoplastics (e.g., polypropylene, polyethylene, thermoplastic polyurethane, etc.), nylon, polyether block amide, fiberglass reinforced polyamides, elastomeric materials, wood, metals, metal alloys, metal composites, composite materials (e.g., carbon fiber, fiberglass, Kevlar®, metal matrix composites, etc.), and/or the like.

In the exemplary implementation, the base 146, the cradle arm 148, and the cradle arm 176 of the heel counter 102 are integrally formed as a single, unitary structure, as is shown herein. The base 146, the cradle arm 148, and/or the cradle arm 176 may be integrally formed using any suitable method, means, process, and/or the like, such as, but not limited to, molding, casting, machining, three-dimensional (3D) printing, and/or the like.

In other implementations, the base 146, the cradle arm 148, and/or the cradle arm 176 are not integrally formed as a single, unitary structure, but at least two of the base 146, the cradle arm 148, and/or the cradle arm 176 are discrete components that are connected together using any suitable method, means, connector, fastener, manner, and/or the like, such as, but not limited to, adhesive, cement, bonding, welding, melding, heat molding, brazing, soldering, threaded fasteners, rivets, clips, pins, a snap-fit connection, an interference-fit connection, and/or the like.

Referring now to the spring 132 of the heel counter 102, the spring 132 is encased within the body 400 of the cradle 130 such that the spring 132 biases the tip portion 150 of the cradle arm 148 toward the expanded position 172 of the tip portion 150. In other words, the spring 132 is operatively connected to the cradle arm 148 such that the spring 132 provides a spring force that biases the tip portion 150 of the cradle arm 148 against movement away from the expanded position 172 in the direction 144. The spring force provided by the spring 132 configures the cradle arm 148 to be resiliently deflectable toward the collapsed position 174 (shown in FIG. 9) of the tip portion 150 (away from the expanded position 172, shown in FIG. 10) against the bias of the spring 132 (i.e., resiliently deflectable in the direction 144).

In the exemplary implementations shown herein, the spring 132 is a cantilever spring. For example, the spring 132 includes a lateral end portion 190, a medial end portion 192, and a spring arm 188 that extends a length from the lateral end portion 190 to the medial end portion 192. The spring arm 188 extends outward from the end portions 190 and 192 to a tip portion 198 of the spring arm 188. The spring arm 188 is cantilevered from the end portions 190 and 192 such that the tip portion 198 of the spring arm 188 is resiliently deflectable in the direction 144 against a bias of the tip portion 198 of the spring arm 188 to the natural resting position of the tip portion 198 shown in FIG. 2. As will be described below, the spring 132 is encased within the body 400 of the cradle such that, when the heel counter 102 is operatively connected to the heel region 112 of the upper 106, the spring arm 188 extends upward from the end portions 190 and 192 toward the ankle opening 110 and toward the posterior wall 114 of the heel region 112.

In the exemplary implementation, the length of the spring arm 188 extends continuously from the end portion 190 to the end portion 192, with the tip portion 198 extending at approximately a central location along the length of the spring arm 188. In other implementations, the length of the spring arm 188 is not continuous between the end portions 190 and 192, but rather is segmented into any number of segments that enables the spring 132 to function as described and/or illustrated herein (e.g., two segments that extend outward from corresponding end portions 190 and 192 to free end portions that are spaced apart by a gap and that define the tip portion 198, etc.).

Figure 7:
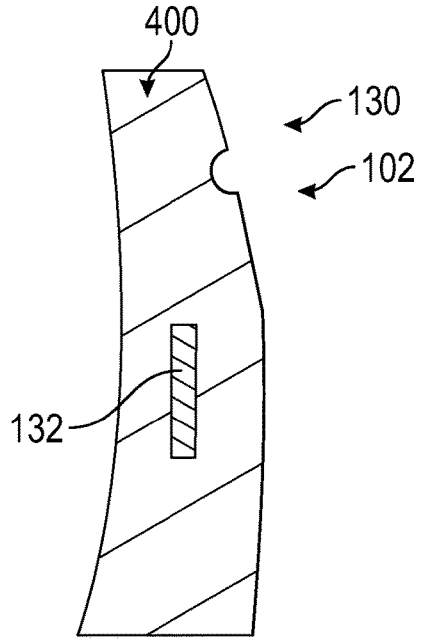
FIG. 7 is a cross-sectional view taken along line 7-7 of FIG. 4 illustrating a cradle arm of the heel counter shown in FIG. 2 according to an implementation.
Figure 8:
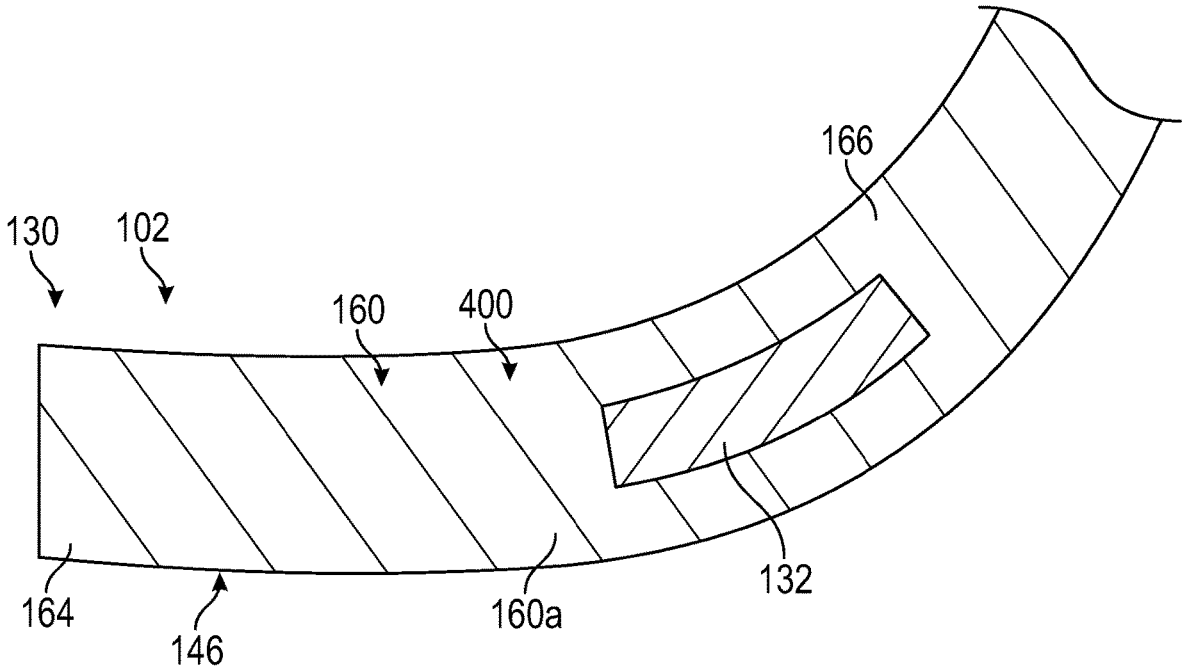
FIG. 8 is a cross-sectional view taken along line 8-8 of FIG. 5 illustrating leg of the heel counter shown in FIG. 2 according to an implementation.

As briefly described above, the spring 132 is encased within the body 400 of the cradle 130. For example, the spring 132 is enveloped within the material of the body 400 of the cradle 130. The cross sections of FIGS. 7 and 8 as well as the hidden lines of FIGS. 3-5 illustrate the encasement of the spring 132 within the body 400 of the cradle 130. In the exemplary implementations shown herein, the spring 132 is encased within the material of the body 400 of the cradle 130 such that the material of the body 400 covers an approximate entirety of a surface area of the spring 132. For example, the hidden lines that indicate the spring 132 in FIGS. 3-5 illustrate that an approximate entirety of the spring 132 is encased within the material of the body 400 such that approximately no portions of the surface area of the spring 132 are exposed through an opening or other void of the body 400. In some other implementations, the spring 132 is encased within the material of the body 400 such that one or more portions of the spring 132 (e.g., the lateral end portion 190, the medial end portion 192, the spring arm 188, the tip portion 198, etc.) is exposed through an opening or other void of the body 400.

The spring 132 is encased within the body 400 of the cradle 130 of the heel counter 102 such that the end portions 190 and 192 of the spring 132 extend along the bottom walls 164 of the respective legs 160*a* and 160*b* of the base 146. Moreover, the spring 132 is encased within the body 400 such that at least a segment of a length of the spring extends within the base 146 of the body 400. For example, in the exemplary implementation, segments of the end portions 190 and 192 of the spring 132 extend within the corresponding bottom walls 164 of the base 146 of the body 400 of the cradle 130. Accordingly, the spring 132 is encased within the body 400 such that the lateral end portion 190 extends along the lateral side 120 of the upper 106 and the medial end portion 192 extends along the medial side 122 of the upper 106 when the heel counter 102 is operatively connected to the heel region 112 of the upper 106. The bottom walls 164 of the base 146 and the bottom wall 126 of the upper 106 support (e.g., hold in place, etc.) the end portions 190 and 192 of the spring 132 to enable the tip portion 198 of the spring arm 188 to resiliently deflect in the direction 144 relative to the end portions 190 and 192.

The spring 132 is encased within the body 400 of the cradle 130 of the heel counter 102 such that at least a segment of the spring arm 188 of the spring 132 extends within the cradle arm 148 of the cradle 130. Accordingly, the spring arm 188 of the spring 132 provides a spring force that resists (i.e., biases against) movement of the cradle arm 148 away from the expanded position 172 in the direction 144 toward the collapsed position 174 (shown in FIG. 9).

In addition or alternatively to a cantilever spring, the spring 132 may include any other type of spring that enables the spring 132 to function as described and/or illustrated herein (e.g., to provide a spring force that configures the cradle arm 148 to be resiliently deflectable in the direction 144, etc.), such as, but not limited to, coil springs, leaf springs, torsion springs, flat springs, and/or the like.

The spring 132 may be fabricated from any material(s) that enable the spring 132 to function as described and/or illustrated herein (e.g., to provide a spring force that configures the cradle arm 148 to be resiliently deflectable in the direction 144, etc.). Examples of suitable materials used to fabricate the spring 132 include, but are not limited to, metals, metal alloys, metal composites, composite materials (e.g., carbon fiber, fiberglass, Kevlar®, metal matrix composites, etc.), elastomeric materials, plastics, thermoplastics, nylon, polyether block amide, fiberglass reinforced polyamides, wood, and/or the like. In some implementations, the spring 132 is metallic, which as used herein is intended to mean the spring 132 includes at least the property of a metal of being resiliently deflectable.

The geometry, material(s), and/or other variables of the various components of the heel counter 102 (e.g., the cradle 130, the spring 132, etc.) may be selected to enable the heel counter 102 to function as described and/or illustrated herein (e.g., to provide the spring 132 with a predetermined spring force, to enable an individual's foot to be received into the foot-receiving cavity 108 of the upper 106 the footwear 100 without the use of a hand and/or other tools, to provide heel counter functionality or assist the functionality of a heel counter (not shown) of the heel region 112 of the upper 106, to provide a predetermined amount of support to the posterior of an individual's heel, etc.). Examples of geometry, materials, and other variables that may be selected to enable (e.g., establish, tune, etc.) the heel counter 102 to function as described and/or illustrated herein include, but are not limited to: the thickness, length, width, angle, shape, geometry, size, cross-sectional shape, path, material composition, and/or the like of the base 146, the cradle arm 148, the cradle arm 176, and/or the spring 132; the method, process, means, manner, and/or the like of encasing the spring 132 within the body 400 of the cradle 130; and/or the like. For example, the spring 132 may include: a wire, a circular cross section, a rectangular cross section, a flat cross section, and/or the like.

The spring 132 may be encased within the body 400 of the cradle 130 using any method, means, process, steps, equipment, tool, and/or the like. In some implementations, the material of the body 400 of the cradle 130 is molded over the spring 132 to encase the spring 132 within the body 400 during fabrication of the body 400 (e.g., the body 400 includes material molded over the spring 132). For example, the body 400 may be fabricated using injection molding, for example wherein the spring 132 is positioned (e.g., pinned, held, secured, etc.) within a mold and liquid material (e.g., above room temperature, at approximately room temperature, below room temperature, etc.) is injected into the mold around the spring 132. Any other molding method, means, process, equipment, step, tool, and/or the like may be additionally or alternatively used. Moreover, in addition or alternative to molding, any other fabrication method, means, process, step, equipment, tool, and/or the like may be used to fabricate the body 400 and/or encase the spring 132 within the body 400.

The spring 132 may be fabricated using any method, means, process, steps, equipment, tool, and/or the like. In some implementations, a body of the spring 132 is fabricated using a molding process (e.g., injection molding, etc.). In addition, or alternative to molding, any other fabrication method, means, process, step, equipment, tool, and/or the like may be used to fabricate the spring 132. For example, an elongate material (e.g., a wire, a cable, a bar, another elongate structure, etc.) may be cut to a predetermined length and shaped to form the spring 132. Examples of shaping the elongate material to form the spring 132 include, but are not limited to: forcing, feeding, and/or the like the elongate material through a mold; winding the spring 132 around a mandrel; and/or the like.

Referring now to FIG. 1, the heel counter 102 is installed to the heel region 112 of the upper 106 such that the cradle 130 is operatively connected to the heel region 112 of the upper 106. In the exemplary implementation, the cradle 130 is mounted to an exterior layer of the upper 106 along the heel region 112 of the upper 106. For example, the cradle 130 is mounted to the backing 200, which in the exemplary implementation defines the exterior layer of the upper 106 along the heel region 112. The cradle 130 may be mounted to the backing 200 of the upper 106 using any suitable method, means, connector, fastener, manner, and/or the like, such as, but not limited to, adhesive, cement, bonding, welding, melding, heat molding, brazing, soldering, threaded fasteners, rivets, clips, pins, a snap-fit connection, an interference-fit connection, and/or the like.

Optionally, the backing 200 includes a flexible material such that the backing 200 is a flexible backing 200, for example to facilitate (e.g., assist, etc.) the functionality of the heel counter 102 (e.g., enabling at least partial collapse of the heel region 112 of the upper 106, enabling stretching of the ankle opening 110 along the longitudinal axis 104, enabling entry of an individual's foot into the footwear 100 without the use of a hand and/or other tools, etc.). Examples of the flexible material of the backing 200 include, but are not limited to, a compressible foam, a compressible foam textile, a flexible textile, leather, vegan leather, vinyl, nylon, a stretchable material, an elastic material, and/or the like.

In the exemplary implementation of the heel counter 102, the cradle 130 is operatively connected to the heel region 112 of the upper 106 such that the base 146 extends along a bottom portion 202 of the heel region 112 of the upper 106. For example, as should be apparent from FIG. 2, the bottom walls 164 of the legs 160 of the base 146 extend between the bottom wall 126 of the upper 106 and the sole structure 124 of the footwear 100; and the side walls 166 of the legs 160 of the base 146 extend overlap the sidewalls 134 of the upper 106 along the portions of the sidewalls 134 defined by the backing 200.

As shown in FIG. 1, when the cradle 130 is operatively connected to the heel region 112 of the upper 106, the cradle arm 148 of the cradle 130 extends upward toward the ankle opening 110 and toward the posterior wall 114 of the heel region 112. In the exemplary implementation, the cradle arm 148 extends over the posterior wall 114 of the heel region 112 when the cradle 130 is operatively connected to the heel region 112. Moreover, the exemplary implementation of the cradle arm 148 extends continuously from the lateral leg 160*a* of the base 146 on the lateral side 120 of the upper 106 to the medial leg 160*b* of the base 146 on the medial side 122 of the upper 106 when the cradle 130 is operatively connected to the heel region 112.

As is also shown in FIG. 1, when the cradle 130 is operatively connected to the heel region 112 in the exemplary implementation: the cradle arm 176 of the cradle 130 extends upward toward the ankle opening 110 and toward the posterior wall 114 of the heel region 112; the cradle arm 176 extends over the posterior wall 114 of the heel region 112; and the cradle arm 176 extends continuously from the lateral leg 106*a* of the base 146 on the lateral side 120 of the upper 106 to the medial leg 160*b* of the base 146 on the medial side 122 of the upper 106.

When the cradle 130 is operatively connected to the heel region 112 of the upper 106 as shown in FIG. 1, the spring arm 188 of the spring 132 extends upward from the end portions 190 and 192 toward the ankle opening 110 and toward the posterior wall 114 of the heel region 112. In the exemplary implementation, the spring arm 188 extends over the posterior wall 114 of the heel region 112 when the cradle 130 is operatively connected to the heel region 112. Moreover, the exemplary implementation of the spring arm 188 extends continuously from the lateral end portion 190 along the lateral side 120 of the upper 106 to the medial end portion 192 along the medial side 122 of the upper 106.

In some implementations, the heel counter 102 is configured to provide heel counter functionality or assist the functionality of a heel counter (not shown) of the heel region 112 of the upper 106. For example, in some implementations the heel counter 102 facilitates holding the heel region 112 open (i.e., facilitates preventing the heel region 112 of the upper 106 from collapsing) at rest or while the footwear 100 is being worn by an individual. In some implementations, the heel counter 102 is configured to support a posterior of the individual's heel.

In operation, and referring now to FIGS. 9 and 10, the heel counter 102 enables an individual's foot to be received into the foot-receiving cavity 108 of the upper 106 of the footwear 100 without the use of a hand and/or other tools (e.g., only the individual's foot is required for successful insertion into the foot-receiving cavity, etc.). For example, using the individual's heel 204, a force F (not shown in FIG. 10) is applied to an upper end portion 206 of the posterior wall 114 of the upper 106. Against the bias provided by the spring 132, the force F resiliently deflects the tip portion 150 of the cradle arm 148 of the heel counter 102 from the expanded position 172 (shown in FIGS. 1 and 10) in the direction 144 toward the collapsed position 174 (shown in FIG. 9). Movement of the tip portion 150 in the direction 144 from the expanded position 172 toward the collapsed position 174 collapses the heel region 112 of the upper 106 along the vertical axis 140 of the footwear 100, for example as is shown in FIG. 9. For example, movement of the tip portion 150 in the direction 144 toward the collapsed position causes the collapsible windows 184 and 186 of the cradle 130 to collapse along the vertical axis 140, thereby collapsing the posterior wall 114 of the heel region 112 along the vertical axis 140. With the posterior wall 114 of the heel region 112 collapsed (e.g., as shown in FIG. 9, etc.), the individual's foot is free to slide forward and downward into the foot-receiving cavity 108 of the upper 106 as is shown in FIG. 10. Accordingly, the heel counter 102 enables the individual's foot to be received into the foot-receiving cavity 108 of the upper 106 without the use of a hand and/or other tools. Rather, only the individual's foot is required to gain entry into the foot-receiving cavity 108 of the upper 106. The heel counter 102 thus eases foot entry into the footwear 100 by enabling hands-free foot entry. As described above, movement of the tip portion 150 of the cradle arm 148 in the direction 144 along an arc may stretch (e.g., enlarge, etc.) the ankle opening 110 of the upper 106 along the longitudinal axis 104 of the footwear 100, which may further facilitate reception of the individual's foot into the foot-receiving cavity 108 of the upper 106 without the use of a hand and/or other tools.

As the individual's foot is fully received into the foot-receiving cavity 108, the stored elastic energy due to the bias of the spring 132 automatically moves the cradle arm 148 back from the collapsed position 174 in the direction of the arrow 208 toward the expanded position 172, as is illustrated in FIG. 10.

Referring again to FIG. 11, the length of the lateral leg 160*a* of the base 146 of the cradle 130 is extended (i.e., longer; e.g., as compared to at least some known heel counters, etc.), for example to reduce or eliminate overpronation of the foot of a wearer of the article of footwear 100. As briefly described above, the lateral leg 160*a* of the base 146 extends a length L outward from the hub 158 of the base 146 along the longitudinal axis 152 to an end portion 162 thereof. The lateral leg 160*a* provides support along the lateral side 120 of the upper 106. The extended length L of the lateral leg 160*a* provides a greater amount of support along the lateral side 120 of the upper 106, for example as compared to at least some known heel counters.

As described above, a midfoot region 118 of the footwear 100 includes portions of the footwear 100 corresponding with a longitudinal arch area of the human foot (e.g., including the navicular joint, the cuboid bone, etc.) when the individual's foot is received within the foot-receiving cavity 108 of the upper 106. For example, the midfoot region 118 of the footwear 100 includes a lateral longitudinal arch area 250 whereat a lateral longitudinal arch 252 of the wearer's foot is generally positioned when the individual's foot is received within the foot-receiving cavity 108 of the upper 106.

Figure 11:
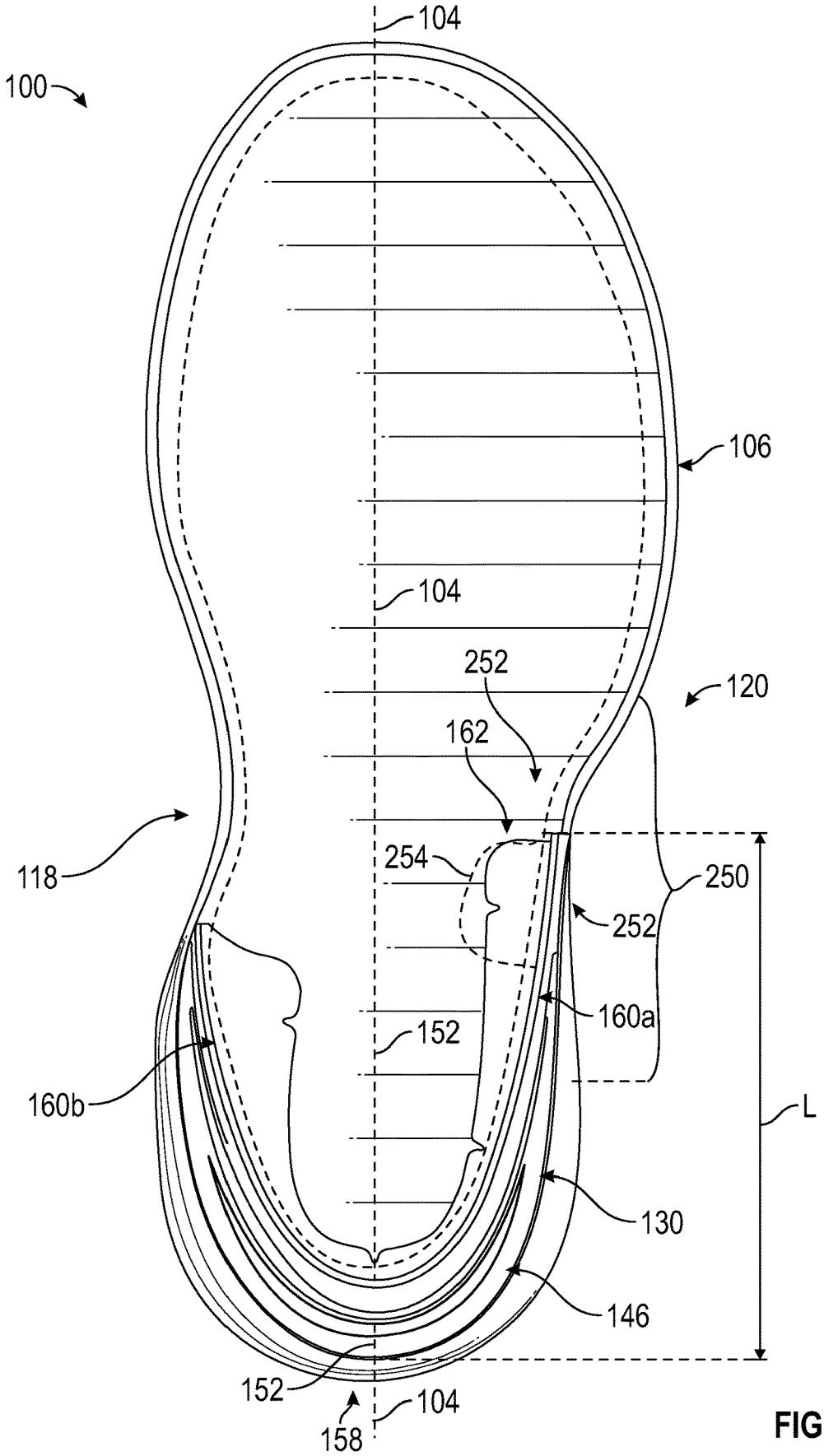

As can be seen in FIG. 11, the length L of the lateral leg 160*a* is selected such that the lateral leg 160*a* extends along (e.g., overlaps, covers, extends over, etc.) at least a portion of the lateral longitudinal arch area 250 of the article of footwear 100. Accordingly, when the individual's foot is received within the foot-receiving cavity 108 of the upper 106, the length L of the lateral leg 160*a* extends along (e.g., overlaps, covers, extends over, etc.) at least a portion of the lateral longitudinal arch 252 of the individual's foot. For example, FIG. 11 illustrates that the length L of the lateral leg 160*a* extends along (e.g., overlaps, covers, extends over, etc.) a cuboid bone 254 of the individual's foot that defines at least a portion of the individual's lateral longitudinal arch 252. The length L of the lateral leg 160*a* may extend along any amount (e.g., any amount of the length along the longitudinal axis 104, etc.) of each of the lateral longitudinal arch area 250, the lateral longitudinal arch 252, and the cuboid bone 254 of the wearer's foot. For example, the length L of the lateral leg 160*a* may be selected to facilitate providing reduced overpronation of an individual's foot while wearing the article of footwear 100. In the exemplary implementation, the length L of the lateral leg 160*a* extends along an approximate entirety of the length of the cuboid bone 254 along the longitudinal axis 104. However, the length L of the lateral leg 160*a* may extend along any other amount of the length of the cuboid bone 254 (e.g., along only a portion of the length of the cuboid bone 254 along the axis 104, etc.), the lateral longitudinal arch area 250, and the lateral longitudinal arch 252 than is shown herein.

The support provided by the length L of the lateral leg 160*a* along the lateral side 120 of the article of footwear 100 is configured to reduce or eliminate overpronation of the foot of the wearer the article of footwear 100. For example, the length L of the lateral leg 160*a* reduces ankle joint eversion movement, plantar force, and/or at least one component of triplanar motion of the wearer's foot while wearing the footwear 100. Accordingly, the length L of the lateral leg 160*a* may reduce injury, fatigue, and/or the like caused by overpronation of the wearer's foot. For example, the length L of the lateral leg 160*a* may facilitate reducing or preventing secondary effects on the lower legs (e.g., increased rotation of the tibia, etc.), lower leg issues, knee issues, overuse injuries (e.g., medial tibial stress syndrome sometimes referred to as "shin splints", knee pain, etc.), and/or the like. As mentioned above, individual results may vary.

In some examples, the length L of the lateral leg 160*a* is greater than the length that the medial leg 160*b* extends along the longitudinal axis 104, for example as shown in FIG. 11. The dimension of the length L of the lateral leg 160*a* may be greater than the dimension of the length of the medial leg 160*b* by any amount. In some implementations, the length L of the lateral leg 160*a* is between approximately twenty percent and approximately thirty percent greater than the length of the medial leg 160*b*. In some implementations, the length L of the lateral leg 160*a* is between approximately twenty-three percent and approximately twenty-seven percent greater than the length of the medial leg 160*b*. In some implementations, the length L of the lateral leg 160*a* is at least twenty-five percent greater than the length of the medial leg 160*b*. In some implementations, the length L of the lateral leg 160*a* is no more than twenty-five percent greater than the length of the medial leg 160*b*. The length L of the lateral leg 160*a* as compared to the length of the medial leg 160*b* may be selected to facilitate providing reduced overpronation of an individual's foot while wearing the article of footwear 100.

Figure 12:
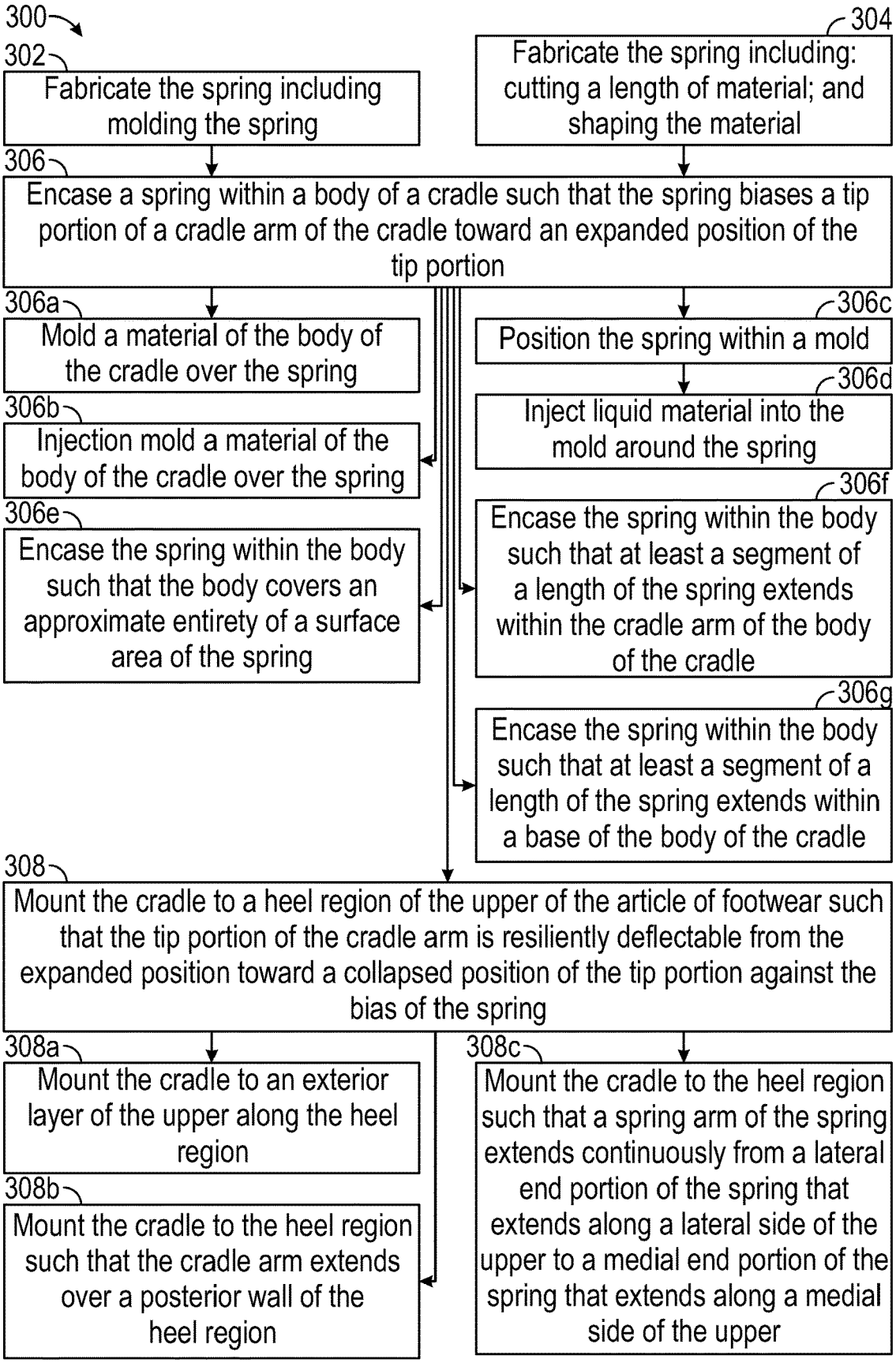
FIG. 12 is a flow chart illustrating an exemplary method for assembling an article of footwear according to an implementation.

FIG. 12 illustrates an exemplary method 300 for assembling an article of footwear (e.g., the footwear 100 shown in FIGS. 1, 2, and 9-11, etc.) that includes an upper and a heel counter (e.g., the heel counter 102 shown in FIGS. 1-11, etc.) that includes a cradle (e.g., the cradle 130 shown in FIGS. 1-11, etc.). It should be appreciated that the steps presented may, in certain instances, be completed in a different order than shown without going outside the scope of the application.

Optionally, the method 300 includes fabricating, at 302, the spring including molding the spring. At 304, the method optionally includes fabricating the spring including: cutting a length of material; and shaping the material.

The method 300 includes encasing, at 306, a spring within a body of the cradle such that the spring biases a tip portion of a cradle arm of the cradle toward an expanded position of the tip portion. At 308, the method 300 includes mounting the cradle to a heel region of the upper of the article of footwear such that the tip portion of the cradle arm is resiliently deflectable from the expanded position toward a collapsed position of the tip portion against the bias of the spring.

In some implementations, encasing at 306 the spring within the body of the cradle includes molding, at 306*a*, a material of the body of the cradle over the spring. In some implementations, encasing at 306 the spring within the body of the cradle includes injection molding, at 306*b*, a material of the body of the cradle over the spring.

Optionally, encasing at 306 the spring within the body of the cradle includes: positioning, at 306*c*, the spring within a mold; and injecting, at 306*d*, liquid material into the mold around the spring.

In some implementations, encasing at 306 the spring within the body of the cradle includes encasing, at 306*e*, the spring within the body such that the body covers an approximate entirety of a surface area of the spring. Optionally, encasing at 306 the spring within the body of the cradle includes encasing, at 306*f*, the spring within the body such that at least a segment of a length of the spring extends within the cradle arm of the body of the cradle. Encasing at 306 the spring within the body of the cradle optionally includes encasing, at 306*g*, the spring within the body such that at least a segment of a length of the spring extends within a base of the body of the cradle.

In some implementations, mounting at 308 the cradle to the heel region includes mounting, at 308*a*, the cradle to an exterior layer of the upper along the heel region. Mounting at 308 the cradle to the heel region optionally includes mounting, at 308*b*, the cradle to the heel region such that the cradle arm extends over a posterior wall of the heel region.

Optionally, mounting at 308 the cradle to the heel region includes mounting, at 308*c*, the cradle to the heel region such that a spring arm of the spring extends continuously from a lateral end portion of the spring that extends along a lateral side of the upper to a medial end portion of the spring that extends along a medial side of the upper.

Various implementations of heel counters and methods disclosed herein enhance the ease of foot entry, allowing hands-free foot entry into an article of footwear. Various implementations of heel counters and methods disclosed herein reduce or eliminate overpronation of the foot of a wearer of an article of footwear.

The following clauses describe further aspects:

Clause Set A:

A1. An article of footwear comprising:

An upper; and

A heel counter operatively connected to a heel region of the upper, the heel counter comprising:

a cradle comprising a body, the body of the cradle comprising a base and a cradle arm extending outward from the base to a tip portion of the cradle arm, the tip portion of the cradle arm being moveable relative to the base between an expanded position and a collapsed position; and a spring encased within the body of the cradle such that the spring biases the tip portion of the cradle arm toward the expanded position of the tip portion, the tip portion of the cradle arm being resiliently deflectable toward the collapsed position against the bias of the spring.

A2. The article of footwear of any preceding clause, wherein the body of the cradle comprises material molded over the spring.

A3. The article of footwear of any preceding clause, wherein the spring is encased within the body of the cradle such that the body covers an approximate entirety of a surface area of the spring.

A4. The article of footwear of any preceding clause, wherein at least a segment of a length of the spring extends within the cradle arm of the body of the cradle.

A5. The article of footwear of any preceding clause, wherein at least a segment of a length of the spring extends within the base of the body of the cradle.

A6. The article of footwear of any preceding clause, wherein the spring comprises a spring arm and an end portion, the spring being encased within the body of the cradle such that the spring arm extends upward from the end portion toward an ankle opening of the upper and toward a posterior wall of the heel region when the cradle is operatively connected to the heel region.

A7. The article of footwear of any preceding clause, wherein the spring comprises a spring arm that extends continuously from a lateral end portion of the spring that extends along a lateral side of the upper to a medial end portion of the spring that extends along a medial side of the upper.

A8. The article of footwear of any preceding clause, wherein the spring comprises at least one of a wire, a circular cross-section, a rectangular cross-section, a flat cross-section, a cantilever spring, or a metal.

A9. The article of footwear of any preceding clause, wherein movement of the tip portion of the cradle arm from the expanded position toward the collapsed position when the cradle is operatively connected to the heel region is configured to collapse the heel region of the upper of the article of footwear.

A10. The article of footwear of any preceding clause, wherein movement of the tip portion of the cradle arm from the expanded position toward the collapsed position when the cradle is operatively connected to the heel region is configured to stretch an ankle opening of the upper of the article of footwear along a longitudinal axis of the article of footwear.

A11. The article of footwear of any preceding clause, wherein the tip portion of the cradle arm moves along an arc between the expanded position and the collapsed position of the tip portion.

A12. The article of footwear of any preceding clause, wherein the cradle is mounted to an exterior layer of the upper along the heel region of the upper when the cradle is operatively connected to the heel region.

A13. The article of footwear of any preceding clause, wherein the cradle arm is a first cradle arm, the cradle comprising a second cradle arm extending outward from the base such that the second cradle arm extends upward toward an ankle opening of the upper and toward a posterior wall of the heel region between the first cradle arm and the base when the cradle is operatively connected to the heel region.

A14. The article of footwear of any preceding clause, wherein at least one of the cradle arm or the spring extends over a posterior wall of the heel region when the cradle is operatively connected to the heel region.

A15. The article of footwear of any preceding clause, wherein the cradle arm of the cradle extends continuously from a leg of the base on a lateral side of the upper to another leg of the base on a medial side of the upper when the cradle is operatively connected to the heel region of the upper.

A16. The article of footwear of any preceding clause, wherein the spring comprises a cantilever spring.

A17. The article of footwear of any preceding clause, wherein the spring comprises a metal.

A18. The article of footwear of any preceding clause, wherein the body of the cradle comprises at least one of a thermoplastic or silicone.

A19. The article of footwear of any preceding clause, wherein the base of the body of the cradle comprises a U-shape.

A20. The article of footwear of any preceding clause, wherein the base of the body of the cradle comprises a U-shape, the base comprising slots extending radially outward into the base along an interior of the U-shape.

A21. The article of footwear of any preceding clause, wherein the base extends along a bottom portion of the heel region of the upper when the cradle is operatively connected to the heel region.

A22. The article of footwear of any preceding clause, wherein the base and the cradle arm of the cradle are integrally formed as a single, unitary structure.

A23. The article of footwear of any preceding clause, wherein the body of the cradle comprises a collapsible window defined between the cradle arm and the base.

Clause set B:

B1. An article of footwear comprising:

an upper; and a heel counter operatively connected to a heel region of the upper, the heel counter comprising:

a cradle comprising a body configured to be operatively connected to a heel region of the upper, the body of the cradle comprising a base and a cradle arm extending outward from the base to a tip portion of the cradle arm, the tip portion of the cradle arm being moveable relative to the base between an expanded position and a collapsed position; and a spring enveloped within a material of the body such that the spring biases the tip portion of the cradle arm toward the expanded position of the tip portion, the tip portion of the cradle arm being resiliently deflectable toward the collapsed position against the bias of the spring.

B2. The article of footwear of any preceding clause, wherein the material of the body has been molded over the spring.

B3. The article of footwear of any preceding clause, wherein the spring is enveloped within the material of the body such that the material of the body covers an approximate entirety of a surface area of the spring.

B4. The article of footwear of any preceding clause, wherein at least a segment of a length of the spring extends within the cradle arm of the body of the cradle.

B5. The article of footwear of any preceding clause, wherein at least a segment of a length of the spring extends within the base of the body of the cradle.

B6. The article of footwear of any preceding clause, wherein the spring comprises a spring arm and an end portion, the spring being enveloped within a material of the body such that the spring arm extends upward from the end portion toward an ankle opening of the upper and toward a posterior wall of the heel region when the cradle is operatively connected to the heel region.

B7. The article of footwear of any preceding clause, wherein the spring comprises a spring arm that extends continuously from a lateral end portion of the spring that extends along a lateral side of the upper to a medial end portion of the spring that extends along a medial side of the upper.

B8. The article of footwear of any preceding clause, wherein the spring comprises at least one of a wire, a circular cross-section, a rectangular cross-section, a flat cross-section, a cantilever spring, or a metal.

Clause Set C:

C1. An article of footwear comprising:

an upper; and a heel counter operatively connected to a heel region of the upper, the heel counter comprising:

a cradle comprising a base that extends a length along a longitudinal axis from a rear end portion of the base to a front-end portion of the base, the rear end portion of the base comprising a hub; and the base comprising lateral and medial legs that extend lengths outward from the hub along the longitudinal axis, wherein the length of the lateral leg is greater than the length of the medial leg.

C2. The article of footwear of any preceding clause, wherein the lateral leg of the base extends along a lateral side of the upper when the cradle is operatively connected to the heel region of the upper such that the lateral leg is configured to provide support on a lateral side of the upper.

C3. The article of footwear of any preceding clause, wherein the length of the lateral leg of the base is configured such that the lateral leg extends along a lateral longitudinal arch of the article of footwear when the cradle is operatively connected to the heel region of the upper.

C4. The article of footwear of any preceding clause, wherein the length of the lateral leg of the base is configured such that the lateral leg is configured to extend along a cuboid bone of a foot of a wearer of the article of footwear.

C5. The article of footwear of any preceding clause, wherein the length of the lateral leg of the base is configured such that the lateral leg is configured to extend along a lateral longitudinal arch of a foot of a wearer of the article of footwear.

C6. The article of footwear of any preceding clause, wherein the length of the lateral leg of the base is between approximately twenty percent and approximately thirty percent greater than the length of the medial leg of the base.

C7. The article of footwear of any preceding clause, wherein the lateral and medial legs of the base include bottom walls that extend along a bottom wall of the upper when the cradle is operatively connected to heel region of the upper.

C8. The article of footwear of any preceding clause, wherein the lateral and medial legs of the base include side walls that extend along corresponding sidewalls of the upper when the cradle is operatively connected to heel region of the upper.

C9. The article of footwear of any preceding clause, wherein the lateral leg of the base is configured to reduce at least one of: ankle joint eversion movement, plantar force, or at least one component of triplanar motion of the foot.

C10. The article of footwear of any preceding clause, wherein the lateral leg of the base is configured to reduce overpronation of a wearer of the article of footwear.

C11. The article of footwear of any preceding clause, wherein the longitudinal axis of the base extends approximately parallel to a longitudinal axis of the article of footwear when the cradle is operatively connected to the heel region of the upper.

C12. The article of footwear of any preceding clause, wherein the cradle comprises a cradle arm extending outward from the base to a tip portion of the cradle arm, the tip portion of the cradle arm being moveable relative to the base between an expanded position and a collapsed position.

Clause Set D:

D1. An article of footwear comprising:

an upper; and a heel counter operatively connected to a heel region of the upper, the heel counter comprising:

a cradle configured to be operatively connected to a heel region of the upper, the cradle comprising a base that extends a length along a longitudinal axis from a rear end portion of the base to a front-end portion of the base, the rear end portion of the base comprising a hub; and the base comprising a lateral leg that extends a length outward from the hub along the longitudinal axis, wherein the length of the lateral leg is configured such that the lateral leg is configured to extend along a lateral longitudinal arch of the article of footwear.

D2. The article of footwear of any preceding clause, wherein the length of the lateral leg of the base is configured such that the lateral leg is configured to extend along a cuboid bone of a foot of a wearer of the article of footwear.

D3. The article of footwear of any preceding clause, wherein the length of the lateral leg of the base is configured such that the lateral leg is configured to extend along a lateral longitudinal arch of a foot of a wearer of the article of footwear.

D4. The article of footwear of any preceding clause, wherein the lateral leg of the base includes a bottom wall that extends along a bottom wall of the upper when the cradle is operatively connected to heel region of the upper.

D5. The article of footwear of any preceding clause, wherein the lateral leg of the base includes a side wall that extends along a corresponding sidewall of the upper when the cradle is operatively connected to heel region of the upper.

D6. The article of footwear of any preceding clause, wherein the lateral leg of the base is configured to reduce at least one of: ankle joint eversion movement, plantar force, or at least one component of triplanar motion of the foot.

D7. The article of footwear of any preceding clause, wherein the lateral leg of the base is configured to reduce overpronation of a wearer of the article of footwear.

D8. The article of footwear of any preceding clause, wherein the longitudinal axis of the base extends approximately parallel to a longitudinal axis of the article of footwear when the cradle is operatively connected to the heel region of the upper.

D9. The article of footwear of any preceding clause, wherein the cradle comprises a cradle arm extending outward from the base to a tip portion of the cradle arm, the tip portion of the cradle arm being moveable relative to the base between an expanded position and a collapsed position.

Clause Set E:

E1. An article of footwear comprising:

an upper defining a foot-receiving cavity having an ankle opening, the upper comprising a heel region; and a heel counter comprising:

a cradle comprising a body configured to be operatively connected to the heel region of the upper, the body of the cradle comprising a base and a cradle arm extending outward from the base to a tip portion of the cradle arm, the tip portion of the cradle arm being moveable relative to the base between an expanded position and a collapsed position; and a spring encased within the body of the cradle such that the spring biases the tip portion of the cradle arm toward the expanded position of the tip portion, the tip portion of the cradle arm being resiliently deflectable toward the collapsed position against the bias of the spring.

Clause Set F:

F1. An article of footwear comprising:

an upper defining a foot-receiving cavity having an ankle opening, the upper comprising a heel region; and a heel counter comprising:

a cradle configured to be operatively connected to the heel region of the upper, the cradle comprising a base that extends a length along a longitudinal axis from a rear end portion of the base to a front-end portion of the base, the rear end portion of the base comprising a hub; and the base comprising lateral and medial legs that extend lengths outward from the hub along the longitudinal axis, wherein the length of the lateral leg is greater than the length of the medial leg.

Clause Set G:

G1. An article of footwear comprising:

an upper defining a foot-receiving cavity having an ankle opening, the upper comprising a heel region; and a heel counter comprising:

a cradle configured to be operatively connected to a heel region of the upper, the cradle comprising a base that extends a length along a longitudinal axis from a rear end portion of the base to a front-end portion of the base, the rear end portion of the base comprising a hub; and the base comprising a lateral leg that extends a length outward from the hub along the longitudinal axis, wherein the length of the lateral leg is configured such that the lateral leg is configured to extend along a lateral longitudinal arch of the article of footwear.

Clause set H:

H1. A method for assembling an article of footwear that includes an upper and a heel counter that includes a cradle, the method comprising:

encasing a spring within a body of the cradle such that the spring biases a tip portion of a cradle arm of the cradle toward an expanded position of the tip portion; and mounting the cradle to a heel region of the upper of the article of footwear such that the tip portion of the cradle arm is resiliently deflectable from the expanded position toward a collapsed position of the tip portion against the bias of the spring.

H2. The method of any preceding clause, wherein encasing the spring within the body of the cradle comprises molding a material of the body of the cradle over the spring.

H3. The method of any preceding clause, wherein encasing the spring within the body of the cradle comprises injection molding a material of the body of the cradle over the spring.

H4. The method of any preceding clause, wherein encasing the spring within the body of the cradle comprises:

positioning the spring within a mold; and injecting liquid material into the mold around the spring.

H5. The method of any preceding clause, wherein encasing the spring within the body of the cradle comprises encasing the spring within the body such that the body covers an approximate entirety of a surface area of the spring.

H6. The method of any preceding clause, wherein encasing the spring within the body of the cradle comprises encasing the spring within the body such that at least a segment of a length of the spring extends within the cradle arm of the body of the cradle.

H7. The method of any preceding clause, wherein encasing the spring within the body of the cradle comprises encasing the spring within the body such that at least a segment of a length of the spring extends within a base of the body of the cradle.

H8. The method of any preceding clause, further comprising fabricating the spring including molding the spring.

H9. The method of any preceding clause, further comprising fabricating the spring comprising:

cutting a length of material; and shaping the material.

H10. The method of any preceding clause, wherein mounting the cradle to the heel region comprises mounting the cradle to an exterior layer of the upper along the heel region.

H11. The method of any preceding clause, wherein mounting the cradle to the heel region comprises mounting the cradle to the heel region such that the cradle arm extends over a posterior wall of the heel region.

H12. The method of any preceding clause, wherein mounting the cradle to the heel region comprises mounting the cradle to the heel region such that a spring arm of the spring extends continuously from a lateral end portion of the spring that extends along a lateral side of the upper to a medial end portion of the spring that extends along a medial side of the upper.

As used herein, a structure, limitation, or element that is "configured to" perform a task or operation is particularly structurally formed, constructed, or adapted in a manner corresponding to the task or operation. For purposes of clarity and the avoidance of doubt, an object that is merely capable of being modified to perform the task or operation is not "configured to" perform the task or operation as used herein.

Any range or value given herein can be extended or altered without losing the effect sought, as will be apparent to the skilled person.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

It will be understood that the benefits and advantages described above can relate to one implementation or can relate to several implementations. The implementations are not limited to those that solve any or all of the stated problems or those that have any or all of the stated benefits and advantages. It will further be understood that reference to 'an' item refers to one or more of those items.

The order of execution or performance of the operations in examples of the present application illustrated and described herein is not essential, unless otherwise specified. That is, the operations can be performed in any order, unless otherwise specified, and examples of the application can include additional or fewer operations than those disclosed herein. For example, it is contemplated that executing or performing a particular operation before, contemporaneously with, or after another operation (e.g., different steps, etc.) is within the scope of aspects and implementations of the application.

The term "comprising" is used in this specification to mean including the feature(s) or act(s) followed thereafter, without excluding the presence of one or more additional features or acts. The terms "comprising," "including," and "having" are intended to be inclusive and mean that there can be additional elements other than the listed elements. In other words, the use of "including," "comprising," "having," "containing," "involving," and variations thereof, is meant to encompass the items listed thereafter and additional items. Accordingly, and for example, unless explicitly stated to the contrary, implementations "comprising" or "having" an element or a plurality of elements having a particular property can include additional elements not having that property. Further, references to "one implementation" or "an implementation" are not intended to be interpreted as excluding the existence of additional implementations that also incorporate the recited features. The term "exemplary" is intended to mean "an example of".

When introducing elements of aspects of the application or the examples thereof, the articles "a," "an," "the," and "said" are intended to mean that there are one or more of the elements. In other words, the indefinite articles "a", "an", "the", and "said" as used in the specification and in the claims, unless clearly indicated to the contrary, should be understood to mean "at least one." Accordingly, and for example, as used herein, an element or step recited in the singular and preceded by the word "a" or "an" should be understood as not necessarily excluding the plural of the elements or steps.

The phrase "one or more of the following: A, B, and C" means "at least one of A and/or at least one of B and/or at least one of C." The phrase "and/or", as used in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one implementation, to A only (optionally including elements other than B); in another implementation, to B only (optionally including elements other than A); in yet another implementation, to both A and B (optionally including other elements); etc.

As used in the specification and in the claims, "or" should be understood to have the same meaning as "and/or" as defined above. For example, when separating items in a list, "or" or "and/or" shall be interpreted as being inclusive, i.e., the inclusion of at least one, but also including more than one of a number or list of elements, and, optionally, additional unlisted items. Only terms clearly indicated to the contrary, such as "only one of or "exactly one of" or, when used in the claims, "consisting of" will refer to the inclusion of exactly one element of a number or list of elements. In general, the term "or" as used shall only be interpreted as indicating exclusive alternatives (i.e., "one or the other but not both") when preceded by terms of exclusivity, such as "either," "one of" "only one of" or "exactly one of" "Consisting essentially of," when used in the claims, shall have its ordinary meaning as used in the field of patent law.

As used in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one implementation, to at least one, optionally including more than one, A, with no B present (and optionally including elements other than B); in another implementation, to at least one, optionally including more than one, B, with no A present (and optionally including elements other than A); in yet another implementation, to at least one, optionally including more than one, A, and at least one, optionally including more than one, B (and optionally including other elements); etc.

Use of ordinal terms such as "first," "second," "third," etc., in the claims to modify a claim element does not by itself connote any priority, precedence, or order of one claim element over another or the temporal order in which acts of a method are performed. Ordinal terms are used merely as labels to distinguish one claim element having a certain name from another element having a same name (but for use of the ordinal term), to distinguish the claim elements.

Having described aspects of the application in detail, it will be apparent that modifications and variations are possible without departing from the scope of aspects of the application as defined in the appended claims. As various changes could be made in the above constructions, products, and methods without departing from the scope of aspects of the application, it is intended that all matter contained in the above description and shown in the accompanying drawings shall be interpreted as illustrative and not in a limiting sense.

It is to be understood that the above description is intended to be illustrative, and not restrictive. For example, the above-described implementations (and/or aspects thereof) can be used in combination with each other. In addition, many modifications can be made to adapt a particular situation or material to the teachings of the various implementations of the application without departing from their scope. While the dimensions and types of materials described herein are intended to define the parameters of the various implementations of the application, the implementations are by no means limiting and are example implementations. Many other implementations will be apparent to those of ordinary skill in the art upon reviewing the above description. The scope of the various implementations of the application should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

This written description uses examples to disclose the various implementations of the application, including the best mode, and also to enable any person of ordinary skill in the art to practice the various implementations of the application, including making and using any devices or systems and performing any incorporated methods. The patentable scope of the various implementations of the application is defined by the claims, and can include other examples that occur to those persons of ordinary skill in the art. Such other examples are intended to be within the scope of the claims if the examples have structural elements that do not differ from the literal language of the claims, or if the examples include equivalent structural elements with insubstantial differences from the literal language of the claims.

The invention claimed is:

1. An article of footwear comprising:

an upper, including a flexible backing; and a heel counter operatively connected to a heel region of the upper, the heel counter comprising:

a cradle comprising a body, the body of the cradle comprising a base;

a first cradle arm extending outward from the base to a first tip portion of the first cradle arm, the first tip portion of the first cradle arm being moveable relative to the base between a first expanded position and a first collapsed position;

a second cradle arm disposed below the first cradle arm extending outward from the base to a second tip portion, the second tip portion of the second cradle arm being moveable relative to the base between a second expanded position and a second collapsed position;

one or more collapsible windows defined between the first cradle arm and the base, wherein the flexible backing is visible through the one or more collapsible windows when the first tip portion is in the first expanded position and when the second tip portion is in the second expanded position; and a spring encased within the body of the cradle such that the spring biases the first tip portion of the first cradle arm toward the first expanded position of the first tip portion, the first tip portion of the first cradle arm being resiliently deflectable toward the first collapsed position against the bias of the spring, wherein the spring includes a lateral end portion of the spring extending along a lateral side and a medial end portion of the spring extending along a medial side, the lateral end portion and the medial end portion each comprising at least a segment of a length of the spring having a straight portion disposed approximately parallel to a longitudinal axis.

2. The article of footwear of claim 1, wherein the body of the cradle comprises material molded over the spring.

3. The article of footwear of claim 1, wherein the spring is encased within the body of the cradle such that the body covers an approximate entirety of a surface area of the spring.

4. The article of footwear of claim 1, wherein at least a segment of a length of the spring extends within at least the first cradle arm.

5. The article of footwear of claim 1, wherein at least a segment of a length of the spring extends within the base of the body of the cradle.

6. The article of footwear of claim 1, wherein the spring comprises a spring arm, the spring being encased within the body of the cradle such that the spring arm extends upward toward an ankle opening of the upper and toward a posterior wall of the heel region.

7. The article of footwear of claim 1, wherein the spring comprises a spring arm that extends continuously from the lateral end portion of the spring to the medial end portion of the spring.

8. The article of footwear of claim 1, wherein the spring comprises at least one of a wire, a circular cross-section, a rectangular cross-section, a flat cross-section, a cantilever spring, or a metal.

9. An article of footwear comprising:

an upper, including a flexible backing; and a heel counter operatively connected to a heel region of the upper, the heel counter comprising:

a cradle comprising a base that extends a length along a longitudinal axis from a rear end portion of the base to a front-end portion of the base, the rear end portion of the base comprising a hub;

a first cradle arm extending outward from the base to a tip portion of the first cradle arm, the tip portion of the first cradle arm being moveable relative to the base between a first expanded position and a first collapsed position;

a second cradle arm disposed below the first cradle arm extending outward from the base to a tip portion, the tip portion of the second cradle arm being moveable relative to the base between a second expanded position and a second collapsed position;

one or more collapsible windows defined between the first cradle arm and the base, wherein the flexible backing is visible through the one or more collapsible windows when the tip portion of the first cradle arm is in the first expanded position and when the tip portion of the second cradle arm is in the second expanded position; and the base comprising lateral and medial legs that extend lengths outward from the hub along the longitudinal axis, wherein the length of the lateral leg is greater than the length of the medial leg; and a spring encased within the cradle such that the spring biases the tip portion of the first cradle arm toward the first expanded position of the tip portion of the first cradle arm, the first tip portion of the first cradle arm being resiliently deflectable toward the first collapsed position against the bias of the spring, wherein the spring includes a lateral end portion of the spring extending along a lateral side and a medial end portion of the spring extending along a medial side, the lateral end portion and the medial end portion each comprising at least a segment of a length of the spring having a straight portion disposed approximately parallel to the longitudinal axis.

10. The article of footwear of claim 9, wherein the lateral leg of the base extends along the lateral side such that the lateral leg is configured to provide lateral support.

11. The article of footwear of claim 9, wherein the length of the lateral leg of the base is configured such that the lateral leg extends along a lateral longitudinal arch of the article of footwear.

12. The article of footwear of claim 9, wherein the length of the lateral leg of the base is configured such that the lateral leg is configured to extend along at least one of:

a cuboid bone of a foot of a wearer of the article of footwear; and a lateral longitudinal arch of the foot of a wearer of the article of footwear.

13. The article of footwear of claim 9, wherein the length of the lateral leg of the base is between twenty percent and thirty percent greater than the length of the medial leg of the base.

14. The article of footwear of claim 9, wherein the lateral and medial legs of the base include bottom walls that extend along a bottom wall of the upper, the lateral and medial legs of the base including side walls that extend along corresponding sidewalls of the upper.

15. The article of footwear of claim 9, wherein the lateral leg of the base is configured to reduce at least one of: ankle joint eversion movement, plantar force, at least one component of triplanar motion of a foot, or overpronation of a wearer of the article of footwear.

16. The article of footwear of claim 9, wherein the cradle is operatively connected to the heel region of the upper.

* * * * *